US006655297B2

(12) United States Patent
Kawato et al.

(10) Patent No.: US 6,655,297 B2
(45) Date of Patent: Dec. 2, 2003

(54) TRANSFER SYSTEM USING MOVABLE BODIES

(75) Inventors: Kenichiro Kawato, Shiga (JP); Takashi Uehara, Shiga (JP); Hisashi Kyotani, Shiga (JP); Takaharu Suzuki, Shiga (JP)

(73) Assignee: Daifuku Co., Ltd. (JP)

( * ) Notice: Subject to any disclaimer, the term of this patent is extended or adjusted under 35 U.S.C. 154(b) by 0 days.

(21) Appl. No.: 10/126,166

(22) Filed: Apr. 19, 2002

(65) Prior Publication Data

US 2003/0196566 A1 Oct. 23, 2003

(51) Int. Cl.[7] ..... E01B 25/22
(52) U.S. Cl. ..... 104/96
(58) Field of Search ..... 104/96, 99, 100, 104/101, 106, 130.01, 130.06, 130.09, 102, 35, 45; 198/468.6, 465.4, 465.1, 465.2, 468.9, 457.01, 157.02; 414/336, 348

(56) References Cited

U.S. PATENT DOCUMENTS 3,056,360 A * 10/1962 Burmeister et al. ..... 104/96
3,623,538 A * 11/1971 Wakabayashi et al. ... 104/172.4
3,683,817 A * 8/1972 Macomber et al. ..... 104/89
4,094,252 A * 6/1978 Pater et al. ..... 104/130.01
4,498,399 A * 2/1985 Wakabayashi ..... 104/96
4,757,767 A * 7/1988 Wesselski et al. ..... 104/49
5,127,336 A * 7/1992 Wakabayashi ..... 104/35
5,195,629 A * 3/1993 Gottstein et al. ..... 198/465.2
5,433,154 A * 7/1995 Chwalik et al. ..... 104/172.4
5,450,796 A * 9/1995 Sakagami ..... 104/89
6,178,891 B1 * 1/2001 Ostholt et al. ..... 104/93

* cited by examiner

*Primary Examiner*—S. Joseph Morano
*Assistant Examiner*—Frantz F. Jules
(74) *Attorney, Agent, or Firm*—Mark Kusner; Michael A. Jaffe

(57) ABSTRACT

In a transfer system using movable bodies supported and guided by a rail through a plurality of guided devices so that they are capable of moving in a given path, when a movable body taken out from the given path is transferred to a separate given path or restored to the original given path, the movable body needs be separated or joined while being longitudinally moved, thus requiring a long path for separating or joining. The invention provides a system comprising a group of guided devices relatively turnably connected to main bodies of the movable bodies through vertical shafts, a plurality of divisional rail bodies capable of supporting the group of guided devices and disposed in a set path portion in the given path, turning means for turning these divisional rail bodies around vertical axes, and a group of transverse rail bodies disposed laterally of the set path portion such that the divisional rail bodies turned for separation from the rail can be connected. Consequently, the movable body can be transversely separated from and joined to the given path.

6 Claims, 21 Drawing Sheets

101
102a
102b
104a
104b
106
106
87
87
105
105
2
2A
2
2A
2
2A
5c
5
5A
40
40
30
30
11
10
12
13
14
15
6
81
81
81A
81A
81A
81A
81
81
81
81A
81A
81A
81A

TRANSFER SYSTEM USING MOVABLE BODIES

FIELD OF THE INVENTION

The preset invention relates to a transfer system using movable bodies in moving the movable bodies, which is used to transfer subjects, for example, in a given path on the floor or ceiling.

BACKGROUND OF THE INVENTION

Heretofore, as for this type of movable body, there has been provided an arrangement found in Japanese Patent Laid-Open No. 7-25441, for example. That is, amovable body movable in a given path as supported and guided by a rail has a main body composed of three frame bodies relatively turnably connected through connecting devices. And each frame body is in the form of a quadrangular body extending in the direction of the given path, with its side surface being formed as a driven surface. The intermediate frame body included in the frame body is provided with a support section for transfer subjects, and guided device to be supported and guided by the rail. Further, the two frame bodies, front and rear, are provided with guided devices to be supported and guided by the rail.

According to the conventional arrangement described above, however, in transferring the movable body to a different given path or returning to the original given path after it has been taken out of the given path, for example, the movable body has to be moved for separating or joining while moving the movable body in the longitudinal direction, thus requiring a long path for separating or joining. Further, when a storage path is formed in the given path to store the movable body, for example, the storage path will be long in length according to the number of storages since this movable body is stored with each frame body put in rectilinear form.

From these facts, it follows that the layout formation for the given path in its entirety cannot be easily effected and that the percentage of occupied area for separating, joining and storing is increased.

DISCLOSURE OF THE INVENTION

Accordingly, an object of the invention is to provide a transfer system using movable bodies, which is capable of moving movable bodies transversely for separating and also for joining, with respect to a given path.

To achieve the object described above, the invention provides a transfer system, using movable bodies that are supported and guided by a rail through a plurality of guided devices disposed on main bodies of the movable bodies so that the movable bodies are movable in a given path, the main bodies being provided with supports for a transfer subject, wherein the group of the guided devices are relatively turnably connected to the main bodies through vertical shafts; the given path has a set path portion which includes therein a plurality of divisional rail bodies capable of supporting the group of guided devices, and turning means for turning these divisional rail bodies around vertical axes; and there are provided laterally of the set path portion a group of transverse rail bodies to which the divisional rail bodies turned for separation with respect to the rail can be connected.

According to the above arrangement of the invention, the group of divisional rail bodies are turned around the vertical axes by the turning means and connected to the rail while they are separated from the transverse rail bodies. Thereby, the guided devices that have moved in can be transferred from the rail to the group of divisional rail bodies and the movable body can be stopped at a position where the guided devices are supported by the corresponding divisional rail bodies.

Subsequently, the group of divisional rail bodies are separated from the rail by the reverse turn of the turning means and then connected to the transverse rail bodies. Such turning force of the divisional rail bodies can turn the guided devices through vertical shafts with respect to the movable body and the support section of the main body; thus, the movable bodies can cause the guided devices to take a transversely facing attitude while causing the group of their main bodies to take an attitude lying along the set path portion.

And, the group of guided devices are moved by suitable transverse moving means. The group of these moving guided devices are transferred from the divisional rail bodies to the transverse rail bodies, so that the movable body can be transversely moved and stopped at a predetermined position with its main body taking an attitude lying along the set path portion. Subsequently, the group of divisional rail bodies are separated from the transverse rail bodies by the reverse turn of the turning means and connected to the rail, whereby they can be restored to the initial state.

In addition, the movable bodies supported by the group of transverse rail bodies can be returned to the original rail by the operation of the divisional rail bodies and turning means that is reverse to the above. Alternatively, similar divisional rail bodies and turning means may be disposed at the free end side (opposite side) of the group of transverse rail bodies, so that after the movable bodies have been transferred from the divisional rails to a separate rail, they can be moved in a separate given path.

Thereby, the main bodies of the movable bodies can be transversely separated from and joined to the given path. Therefore, a path suffices for separating and joining can be shortened, and when the transverse path portion consisting of the group of transverse rail bodies is used as a storage path, for example, the movable bodies can be stored in a side-by-side state, so that the storage path can be reduced in total length according to the storage number. From these facts, the formation of the entire layout of the given path can be easily made and the occupied area for separating, joining or storage can be minimized.

Further, the invention provides a transfer system using movable bodies, in which the movable bodies are supported and guided by a rail through a plurality of guided devices so that they are movable in a given path, the movable body having a main body composed of a plurality of frame bodies horizontally connected to be relatively turnable through connecting devices, at least one of the frame bodies being provided with a support section for transfer subjects, wherein the group of guided devices are relatively turnably connected to the movable bodies through vertical shafts; the given path has a set path portion which includes therein a plurality of divisional rail bodies capable of supporting the group of guided devices, and turning means for turning these divisional rail bodies around vertical axes; and there are provided laterally of the set path portion a group of transverse rail bodies to which the divisional rail bodies turned for separation with respect to the rail can be connected.

According to the above arrangement of the invention, the group of divisional rail bodies are turned around the vertical axes by the turning means and connected to the rail while they are separated from the transverse rail bodies. Thereby, the guided devices that have moved in, or the group of guided devices disposed in the group of frame bodies, can be transferred from the rail to the group of divisional rail bodies and the movable body can be stopped at a position where the guided devices are supported by the corresponding divisional rail bodies.

Subsequently, the group of divisional rail bodies are separated from the rail by the reverse turn of the turning means and then connected to the transverse rail bodies. Such turning force of the divisional rail bodies can turn the guided devices through vertical shafts with respect to the main body of the movable body and the support section; thus, the movable bodies can cause the guided devices to take a transversely facing attitude while causing the group of frame bodies of the movable bodies to take an attitude lying along the set path portion.

And, the group of guided devices are moved by suitable transverse moving means. The group of these moving guided devices are transferred from the divisional rail bodies to the transverse rail bodies, so that the movable bodies can be transversely moved and stopped at a predetermined position with the group of frame bodies taking an attitude lying along the set path portion. Subsequently, the group of divisional rail bodies are separated from the transverse rail bodies by the reverse turn of the turning means and connected to the rail, whereby they can be restored to the initial state.

Thereby, the group of frame bodies of the movable bodies can be transversely separated from and joined to the given path. Therefore, a path suffices for separating and joining can be shortened, and when the transverse path portion consisting of the group of transverse rail bodies is used as a storage path, for example, the movable bodies can be stored with the group of frame bodies arranged in a side-by-side state, so that the storage path can be reduced in total length according to the storage number. From these facts, the formation of the entire layout of the given path can be easily made and the occupied area for separating, joining or storage can be minimized.

A first preferred embodiment of the invention in a transfer system using movable bodies is characterized in that the connecting device horizontally connects the frame bodies to be relatively turnable through a vertical shaft, and the guided device is relatively turnably connected to the end of the vertical shaft.

According to this first embodiment, in a linear path portion in the given path, the movable bodies can be moved with their main bodies, or each of the frame bodies, kept in a linear state as seen in a plan view and a side view. Further, in a horizontal curved path, the frame bodies can be moved as they are bent along the curve in the connecting device, as seen in a plan view. In that case, the bending is allowed to take place by relative turning around the vertical shaft. Further, the guided device turns through the vertical shaft serving as the connecting device, whereby it can smoothly move while automatically changing its direction along the horizontal curve of the rail and also smoothly turn following the turning of the divisional rail body.

A second preferred embodiment of the invention in a transfer system using movable bodies is characterized in that the connecting device horizontally connects the frame bodies to be relatively turnable through a vertical shaft and vertically connects the frame bodies to be relatively turnable through a transverse shaft, and an end of the vertical shaft and the guided device are relatively turnably connected through a transverse pin passing through the end of the vertical shaft.

According to this second embodiment, in a vertical curved path portion in the given path, the frame bodies can be moved as they are put in an attitude bent along the curve in the connecting device as seen in a plan view. In that case, the bending can be automatically reliably effected by relative turning around the transverse shaft. And the guided device turns through the transverse pin, so that it can be smoothly moved while automatically changing its direction with respect to the vertical displacement and deformation of the rail.

A third preferred embodiment of the invention in a transfer system using movable bodies is characterized in that the main body of the movable body has a side surface formed as a driven surface, and a feed device having a feed roller capable of abutting against the driven surface is disposed in the given path.

According to this third embodiment, the feed roller forcibly rotated is abutted against the driven surface of the movable body, whereby the feed rotating force can impart a moving force (traveling force) to the movable body, thereby easily and reliably moving the movable body.

A fourth preferred embodiment of the invention in a transfer system using movable bodies is characterized in that the movable body is provided with a support section for transfer subjects, the support section being disposed in a lower portion of at least one of the frame bodies.

According to this fourth embodiment, the movable bodies of suspended transfer type can be transversely moved with the support sections being held horizontal.

EMBODIMENTS

Figure 1:
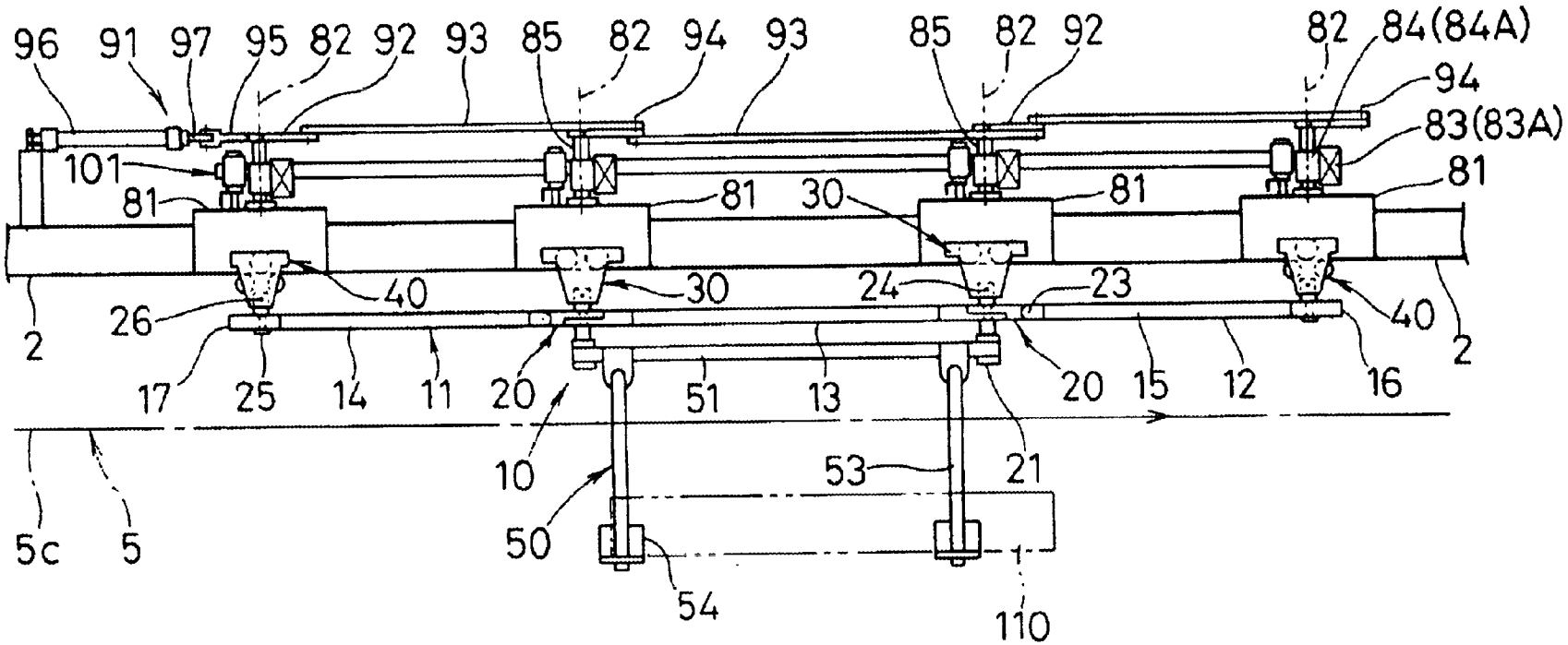
FIG. 1 is a side view of a divisional rail body portion, before tuning, in a transfer system using movable bodies, according to a fit embodiment of the invention.

A first embodiment of the invention will now be descried with reference to FIGS. 1 through 17, with movable bodies employed for an:overhead traveling type.

In FIGS. 7 through 13, a rail 2 that is I-shaped in section is laid on a machine frame 1 from the ceiling. The rail 2 defines a given path 5 that, as seen in a plan view, is composed, for example, of a rectilinear operating path portion 5*a*, a rectilinear return path portion (an example of a set path portion) 5*c* connected to the terminal end of the operating path portion 5*a* through a curved path portion 5*b* and the like.

Further, this portion of the return path portion 5*c* is formed with a transverse path portion 6 orthogonal thereto. And this transverse path portion 6 is formed with a different given path 5A orthogonal thereto and parallel with the return path portion 5*c*, the given path 5A being composed of a rail 2A that is similarly I-shaped in section and the like.

Movable bodies 10 are provided that are movable in the given paths 5 and 5A as they are supported and guided by the rails 2 and 2A. Each movable body 10 has its main body 11 composed of three (plurality) frame bodies 12, 13, and 14. Each of the frame bodies 12, 13, and 14 is composed of a quadrangular prism (quadrangular bar-like body) extending in the direction of the given paths 5 and 5A, a front end member integrated with the front ends of these four quadrangular prisms, a rear end member integrated with the rear end, and the like, and both side surfaces of the main body 11 provide driven surfaces 15.

In addition, the front and rear surfaces of the main body 11, that is, the front surface (free end portion) of the front frame body 12 and the rear surface (free end portion) of the rear frame body 14 are formed as abutment portions 16 and 17.

The front and intermediate frame bodies 12 and 13, and the intermediate and rear frame bodies 13 and 14 are respectively connected for relative horizontal and vertical turning through connecting devices 20. The connecting devices 20 are each disposed between the rear end member of the front frame body 12 and the front end member of the intermediate frame body 13 and between the rear end member of the intermediate frame body 13 and the front end member of the rear frame body 14.

That is, the connecting devices 20 employed are of a trunnion type in which connecting bodies 22 are connected to the front and rear end members of the intermediate frame body 13 for relative horizontal turning through vertical shafts 21 and in which such connecting bodies 22 are connected to the rear end member of the front frame body 12 and the front end member of the rear frame body 14 for relative vertical turning through horizontal shafts 23. In that case, the vertical shaft 21 is also arranged to be relatively turnable (rotatable) around the vertical axis 21*a* with respect to the intermediate frame body 13 and connecting body 22.

The movable body 10 is supported and guided by the rails 2 and 2A through a plurality of guided devices; thus, it is arranged to be movable along the given paths 5 and 5A. In that case, the guided device is composed of intermediate guided devices 30 connected to the vertical shafts 21, and end guided devices 40 connected to vertical shafts 25 disposed in the front end member of the front frame body 12 and the rear end member of the rear frame body 14, these guided devices 30 and 40 being of a similar trolley type. In that case, the vertical shaft 25 is arranged to be relatively turnable (rotatable) around vertical axis 25*a* with respect to the front and rear frame bodies 12 and 14.

That is, the trolley main body 31 of the intermediate guided device 30 is composed of a pair of right and left support plate bodies 31*a*, and a pair of front and rear connecting plate bodies 31*b* fixed between lower portions of the support plate bodies 31*a*. And the upper portions of both support plate bodies 31*a* have a pair of front and rear transverse pins 32 connected thereto and directed inward, the inwardly projecting portions of these transverse pins 32 have supported rollers 33 freely rotatably attached thereto that engage the rails 2 and 2A and are supported and guided by the rails 2 and 2A.

Connected to the upper portions of both support plate bodies 31*a* longitudinally outwardly of the places where the transverse pins 32 are disposed are brackets 34 directed inward, these brackets 34 having downwardly directed vertical pins 35 fixed thereto, these vertical pins 35 having guided rollers 36 freely rotatably attached thereto that abut against and are guided by the rails 2 and 2A.

And the intermediate guided device 30 is relatively turnably connected to the upper end of the vertical shaft 21. That is, the vertical shaft 21 is inserted between both support plate bodies 31*a* and between both connecting plate bodies 31*b*, and a transverse pin 24 to be passed through between both support plate bodies 31*a* extends through the upper end of the vertical shaft 21. This establishes a connection between the upper end of the vertical shaft 21 and the intermediate guided device 30 through the transverse pin 24 extending through the upper end of the vertical shaft 21.

Further, the end guided device 40, which is approximately similar to the intermediate guided device 30, has a trolley main body 41 composed of a pair of right and left support plate bodies 41*a*, and a plurality of cylindrical space members 41*c* installed between the lower portions of these support plate bodies 41*a* through fasteners (bolts and nuts) 41*b*. And a single transverse pin 42 is connected, as inwardly directed, to the upper portions of both support plate bodies 41*a*, and such transverse pins 42 have supported rollers 43 freely rotatably attached to the inwardly projecting ends thereof that engage the rails 2 and 2A and are supported and guided by the rails 2 and 2A.

Further, connected to the upper portions of both support plate bodies 41*a* longitudinally of the places where transverse pins 42 are disposed are brackets 44 directed inward, these brackets 44 having downwardly directed vertical pins 45 fixed thereto, these vertical pins 45 having guided rollers 46 freely rotatably attached thereto that abut against the rails 2 and 2A and guided. Further, of the cylindrical space members 41*c*, a predetermined pair of members, front and rear, are freely rotatably provided with float-preventing rollers 47 opposed to the rails 2 and 2A from below.

And the end guided device 40 is relatively turnably connected to the upper end of the vertical shaft 25. That is, the vertical shaft 25 is inserted between both support plate bodies 41*a* and between both float-preventing rollers 47, and a transverse pin 26 inserted between both support plate bodies 41*a* extends through the upper end of the vertical shaft 25. Thereby, connection between the upper end of the vertical shaft 25 and the end guided device 40 is effected through the transverse pin 26 passing through the upper end of the vertical shaft 25.

The movable body 10 is provided with a support section 50 for transfer subjects. That is, the support section 50 for transfer subjects is positioned below the intermediate frame body 13 of the frame bodies 12, 13 and 14. This support section. 50 comprises a longitudinal member 51 disposed between the lower ends of the intermediate vertical shafts 21, left-right arm members 53 connected to the front and rear ends of this longitudinal member 51 through brackets 52, supports 54 for transfer subjects disposed at the free ends of these arm members 53, and the like. In that case, the vertical shaft 21 is arranged to be relatively rotatable (rotatable) around the vertical axis 21*a* with respect to the longitudinal member 51.

Figure 7:
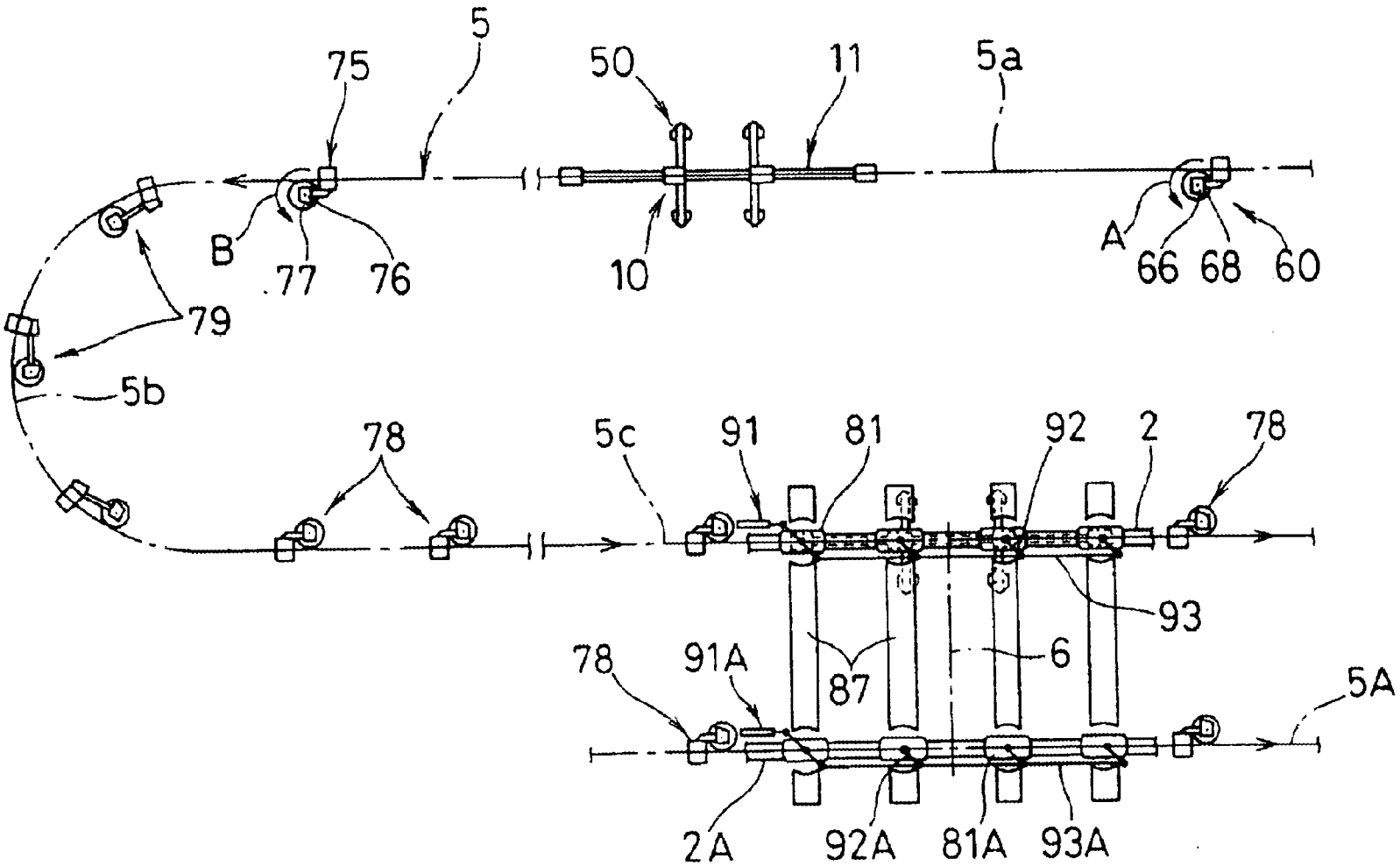
FIG. 7 is a schematic plan view of a given path portion in the transfer system using movable bodies.
Figure 11:
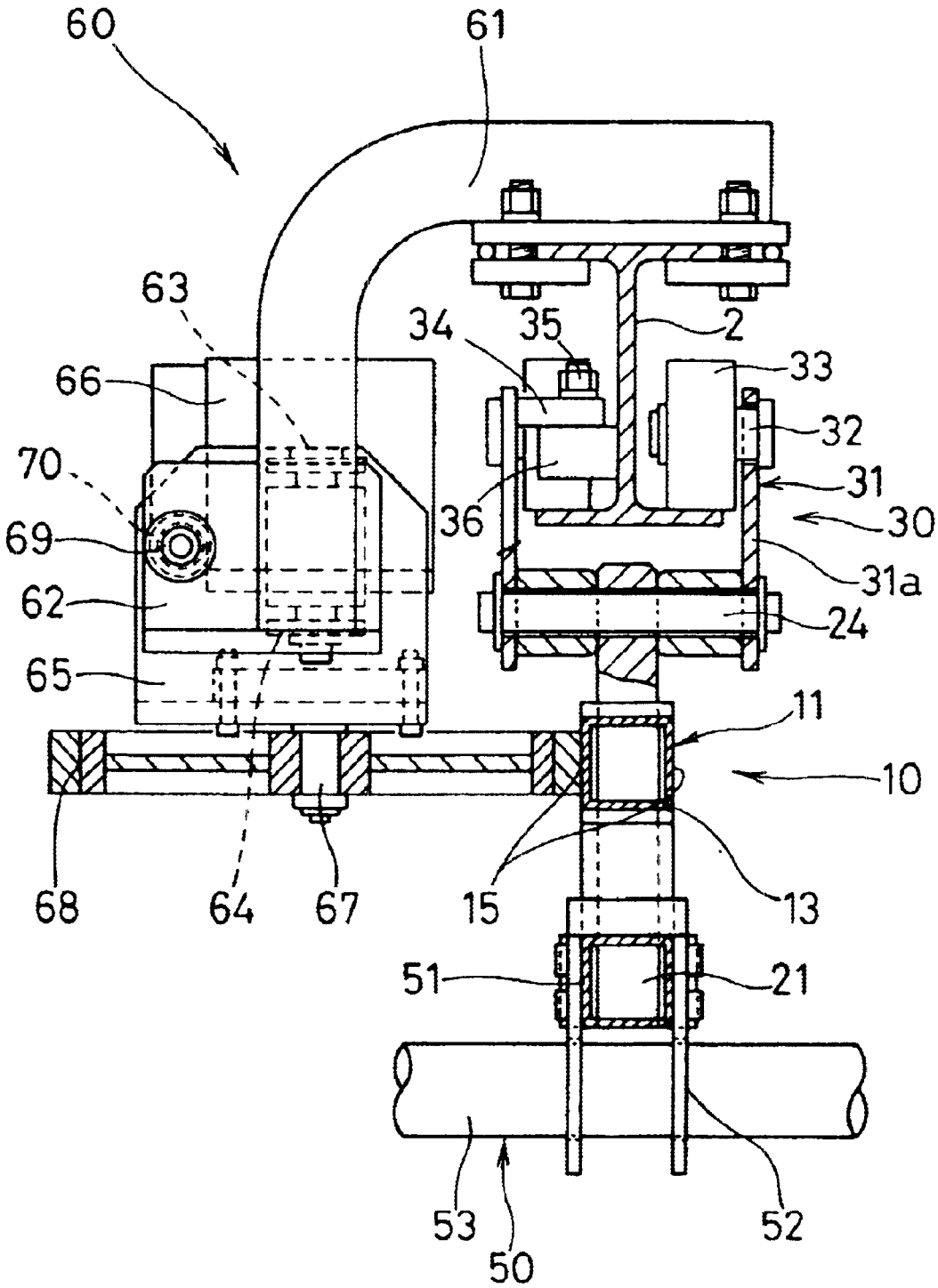
FIG. 11 is a rear view, partly broken away, of the movable body in a feed device portion in the transfer system using movable bodies.
Figure 12:
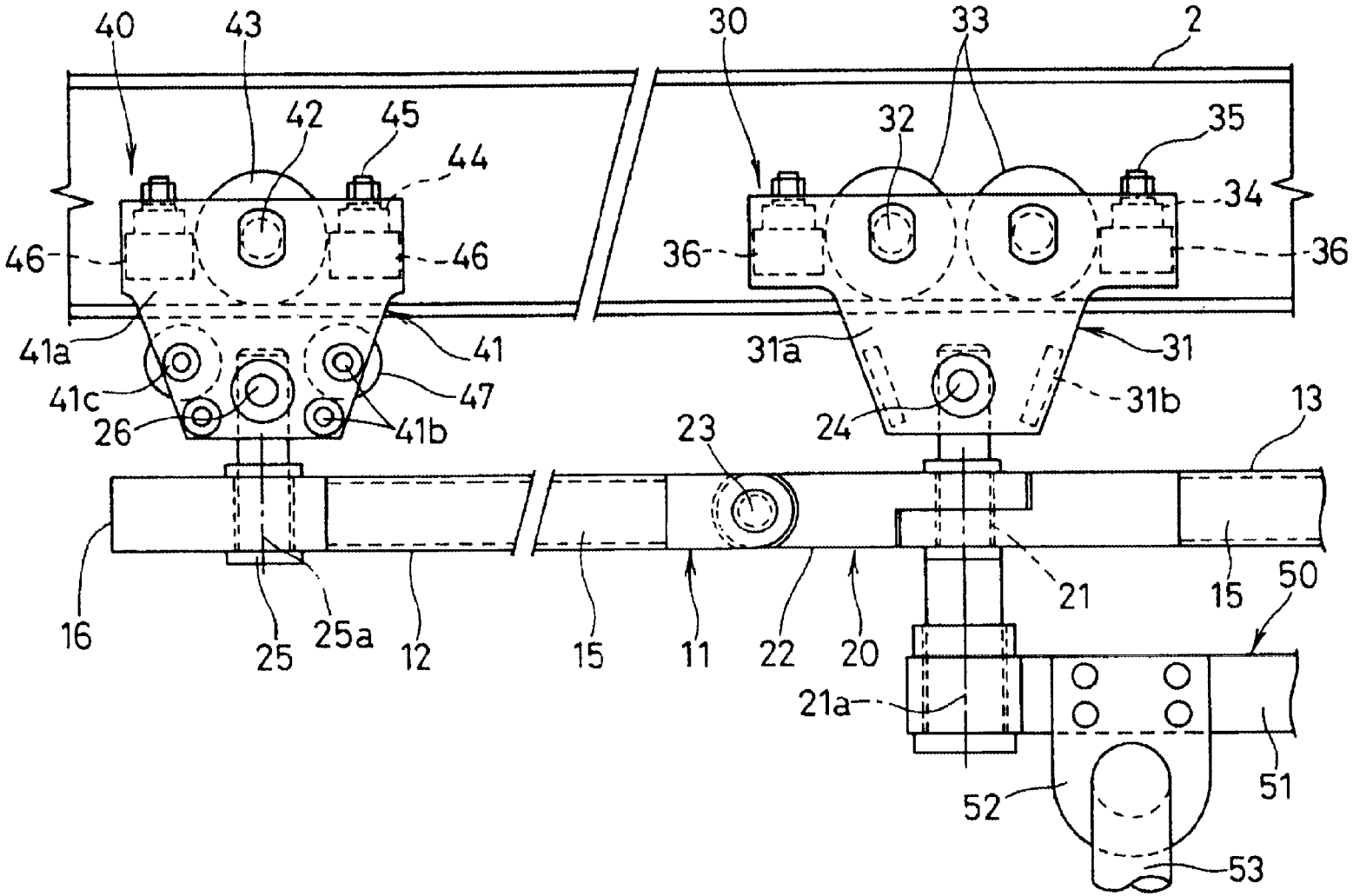
FIG. 12 a side view of the principal portions of the movable body in the transfer system using movable bodies.
Figure 14:
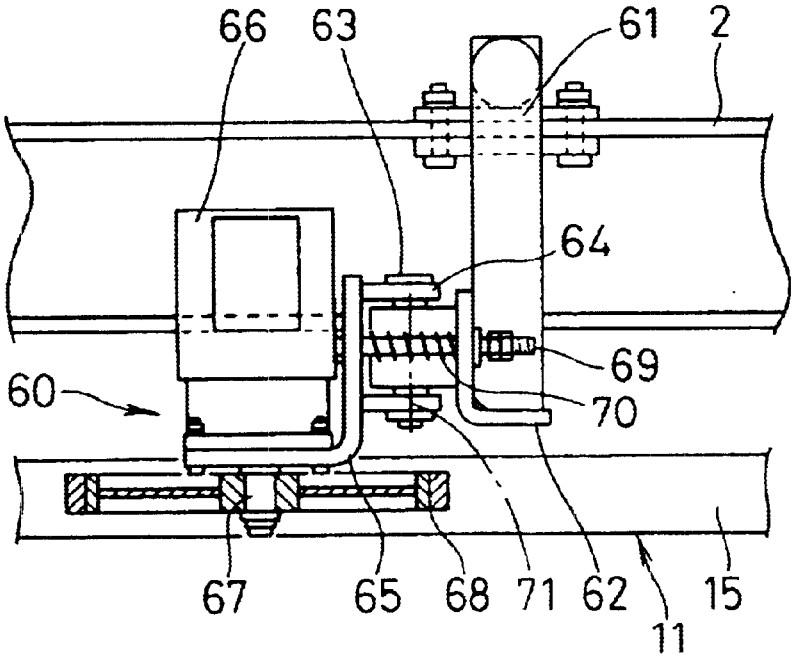
FIG. 14 is a side view, partly broken away, of the feed device portion in the transfer system using movable bodies.
Figure 15:
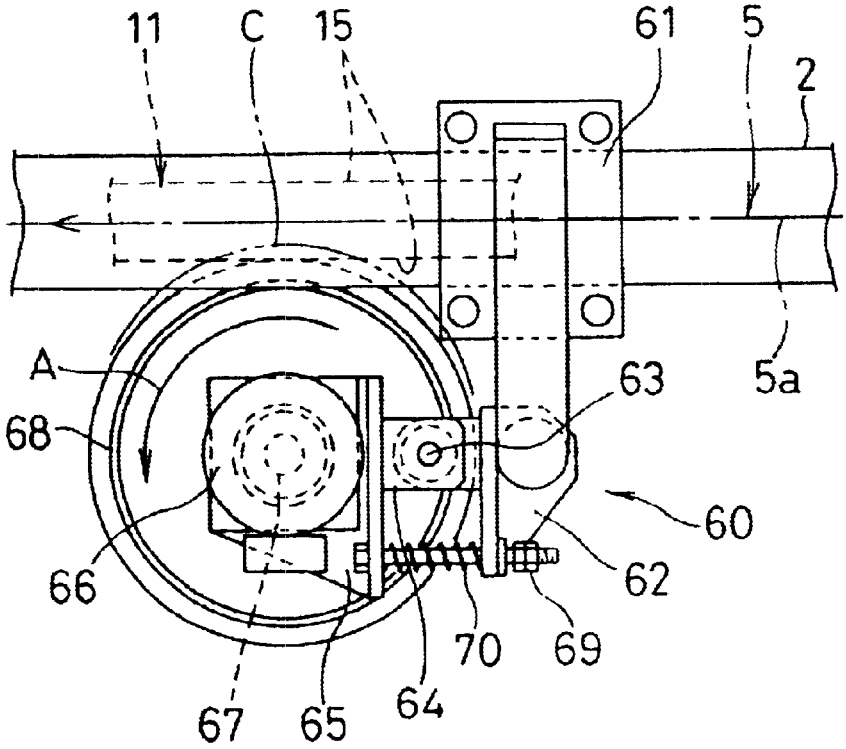
FIG. 15 is a plan view of the feed device portion in the transfer system using movable bodies.
Figure 16:
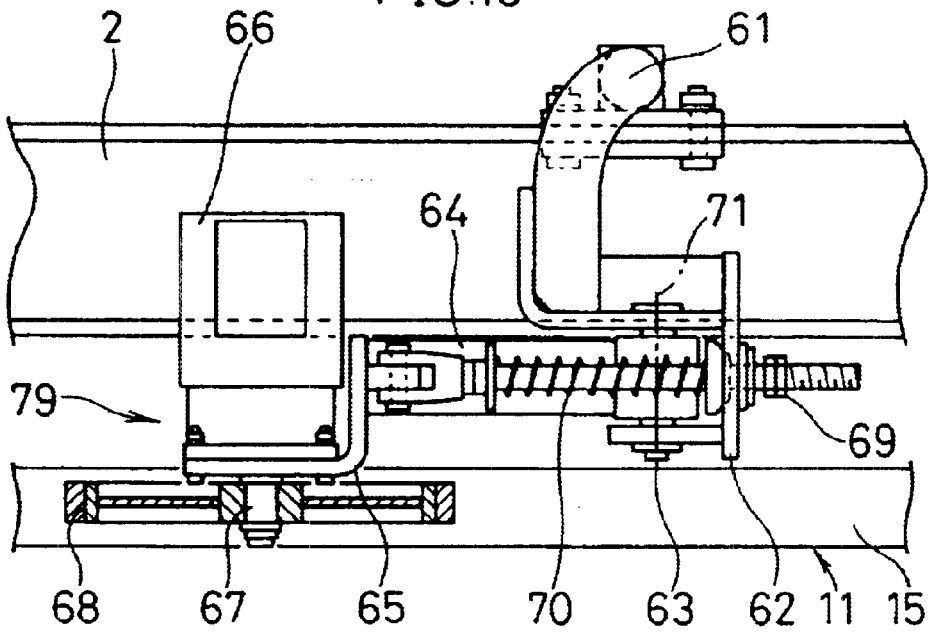
FIG. 16 is a side view, partly broken away, of a curve feed device portion the transfer system using movable bodies.
Figure 17:
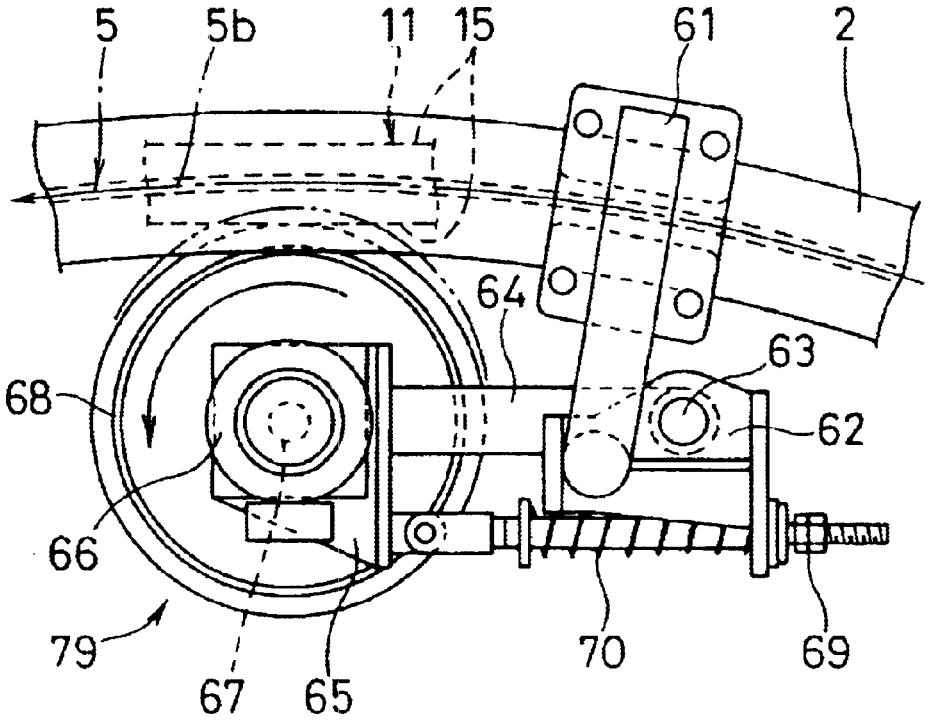
FIG. 17 a plan view of the curve feed device portion in the transfer system using movable bodies.

In FIG. 7, the initial end of the operating path portion 5*a* is provided with a feed device 60 that acts on the driven surface 15 to impart a moving force to the movable body 10. This feed device 60, as shown in FIGS. 11, 14 and 15, has a base frame 61 attached to the upper surface of the rail 2, and a bracket 62 from the base frame 61 rotatably supports a vertical shaft 63. The vertical shaft 63 has a link body 64 attached thereto, the link body 64 having a support member 65 attached to the free end thereof.

And disposed on the upper surface of the support member 65 is an induction motor 66 with a speed reducing mechanism that is an example of a rotation drive device, and an output shaft 67 extending downward from the induction motor 66 has fixed to thereto, for example, a feed roller 68 whose outer peripheral portion is made of urethane. In addition, it is arranged that the induction motor 66 imparts a feed rotating force A to the feed roller 68.

Inserted between the bracket 62 and the support member 65 with the vertical shaft 63 in the middle is a swing control element 69 adjustable in the bolt-nut manner, and a compression spring 70 fitted on the bolt is disposed between the bracket 62 and the support member 65. The 61–70, and the like constitute an example of a feed device 60.

Therefore, the feed device 60 causes the support member 65 and the link body 64 to swing inward around the vertical axis 71 under the elastic repulsive force of the compression spring 70, thereby making it possible to urge the feed roller 68 in the direction to abut against the driven surface 15. In that case, the closest approach position is controlled by the swing control element 69.

In FIG. 7, the terminal end portion of the operating path portion 5*a* is provided with a brake device 75 for acting on the driven surface 15 to impart a braking force to the movable body 10. This brake device 75, which is of the same construction as that of the feed device 60, is composed of a braking roller 76 made, e.g., of urethane and capable of laterally abutting against the driven surface 15 in the main body 11, a rotation drive device 77 operatively connected to the braking roller 76 for imparting a feed rotating force B to the braking roller 76, and the like. In addition, the rotation drive device 77 is composed of a torque motor, and the like, and its feed rotating, force B is set to be lower than the feed rotating force A from the induction motor 56; that is, A>B.

Therefore, in the operating path portion 5*a*, it is arranged that a plurality of movable bodies 10 travel without creating a clearance between front and rear ends thereof in a region between the feed device 60 and the brake device 75, i.e., with the front and rear abutments 16 and 17 in the abutting state, aligned in a closely pushing behind manner.

Feed devices 78 similar to the feed device 60 are disposed in a predetermined place 7 of the rectilinear return path portion 5*c*, a separate given path 5A, and the like. Further, as shown, in FIGS. 16 and 17, the curved path portion 5*b* is provided with a feed device 79 similar to the feed device 60. In addition, in FIGS. 16 and 17, the same reference numerals are applied to components similar to those of the feed device 60 and a detailed description thereof is omitted. The arrangement patterns of the devices 60, 75, 78 and 79 are variously changed, and part or all of the devices 60, 75, 78, and 79 may be omitted.

As shown in FIGS. 1 through 7, the return path portion 5*c*, which is the set path portion in the given path 5, is provided with four (plurality) divisional rail bodies 81 capable of supporting the guided devices groups 30 and 40. These divisional rail bodies 81, which are I-shaped in section as in the rail 2, are formed in such a manner as to divide the rail 2. Each divisional rail body 81 is arranged to be rotatable around a vertical axis 82. For this reason, a bearing 84 is installed on a pedestal 83 supported on the ceiling, and the divisional rail body 81 is connected to the lower end of a vertical shaft 85 supported for only rotation in the bearing 84.

And a turning means 91 is provided for turning the group of divisional rail bodies 81 around the vertical axis 82. That is, a link 92 is fixed to the upper end of each vertical shaft 85, with a link plate 93 being relatively turnably connected between the free ends of these links 92 through a vertical pin 94. An operating link 95 is fixed to one vertical shaft 85, and the piston rod 97 of a cylinder device 96 turnably installed on the pedestal 83 is relatively turnably connected to the free end of the operating link 95 through a vertical pin 98. The 92–98 described above constitute an example of the turning means 91.

Divisional rail bodies and turning means similar to those described above are installed in a separate given path 5A disposed side by side with the return path portion 5*c*, in which case the character A is added to the numerals for the same components to omit a detailed description thereof. That is, 81A is the divisional rail body; 82A is the vertical axis; 83A is the pedestal; 84A is bearing; 85A is the vertical shaft; 91A is the turning means; 92A is the link; 93A is the link plate; 94A is the vertical pin; 95A is the operating link; 96A is the cylinder device; 97A is the piston rod; and 98A is the vertical pin.

Four (plurality) transverse rail bodies 87 extending laterally of the return path portion 5*c* and over the other given path 5A and orthogonal to the return path portion 5*c* are disposed at predetermined intervals in the direction of the return path portion 5*c*. Divisional rail bodies 81 and 81A separation-turned with respect to the rails 2 and 2A are connectible to the transverse rail bodies 87. The transverse rail bodies 87 are I-shaped in section as in the divisional rail bodies 81 and 81A and the rails 2 and 2A.

In addition, the transverse rail bodies 87 are disposed evenly on both sides of the return path portion 5*c* and the other given path 5A. In that case, the distance between the return path portion 5*c* and the other given path 5A is of predetermined long dimension; thus, the transverse path portion 5*d* for movable bodies 10 is orthogonal to the return path portion 5*c* and the other given path 5A. Further, the other side of the return path portion 5*c* is short-sized for standby uses for a transverse moving means (to be later described), and the other side of the other given path 5A is also short-sized for installation of the transverse moving means.

Both end surfaces of the divisional rail bodies 81 and 81A are arcuate surfaces with the centers at the vertical axes 82 and 82A, while opposite surfaces of the rails 2 and 2A and transverse rail bodies 87 are concavely arcuate; thus, the arcuate surfaces and concavely arcuate surface can be intimately connected and the turning of the divisional rail bodies 81 and 81A can be smoothly effected.

The transverse rail bodies 87 are provided with a transverse moving means 101 for transversely moving the movable body 10 in the transverse path portion 6. That is, disposed above both ends of the transverse rail bodies 87 are shaft 102*a* and 102*b* extending along the return path portion 5*c*, the shafts 102*a* and 102*b* are turnably supported in bearings 103*a* and 103*b* from the pedestal 83 and 83A. Both shafts 102*a* and 102*b* are provided with pulleys 104*a* and 104*b* corresponding to the divisional rail bodies 81 and 81A, and a belt (an endless rotary body) 105 is entrained around the pulleys 104*a* and 104*b* opposed to each other in the direction of the transverse path portion 6.

Connected to one place of each of these belts 105 is a transverse push body 106, which has a main body 107 connected to the belt 105, and a transverse push member 108 disposed on the lower surface of the main body 107. And the main body 107 is arranged to be supported and guided by the upper flanges of the divisional rail bodies 81 and 81A and the transverse rail bodies. 87 through a plurality of freely rotatable rollers 109.

The transverse push member 108 is arranged to be capable of abutting against the trolley main bodies 31 and 41 in the guided devices 30 and 40. In addition, either one of the shafts 102*a* and 102*b* is operatively connected to a forwardly and backwardly drivable driving device (not shown). Shafts 102*a*, 102*b* and rollers 109 constitute an example of the transverse moving means 101.

The operation of the first embodiment described above will now be described.

As shown in FIG. 7, the movable body 10 being moved in the operating path portion 5*a* by the feed rotating force of the feed device 78 is given a moving force (traveling force) by the feed rotating force A of the feed device 60 disposed in the operating path portion 5*a*.

That is, as shown in a phantom line C in FIG. 15, the feed roller 68 projected inward by the elastic force of the compression spring 70 abuts against the driven surface 15 of the movable body 10 that has been fed in, which means that as shown in solid line in FIG. 15, it is pressed against the driven surface 15 in the state in which it is retracted against the elastic force of the compression spring 70. At this time, the feed roller 68 is being driven for rotation by the induction motor 66, so that pressing the feed roller 68, being forcibly rotated, against the driven surface 15 results in the movable body 10 being given a moving force by the feed rotating force A.

Figure 9:
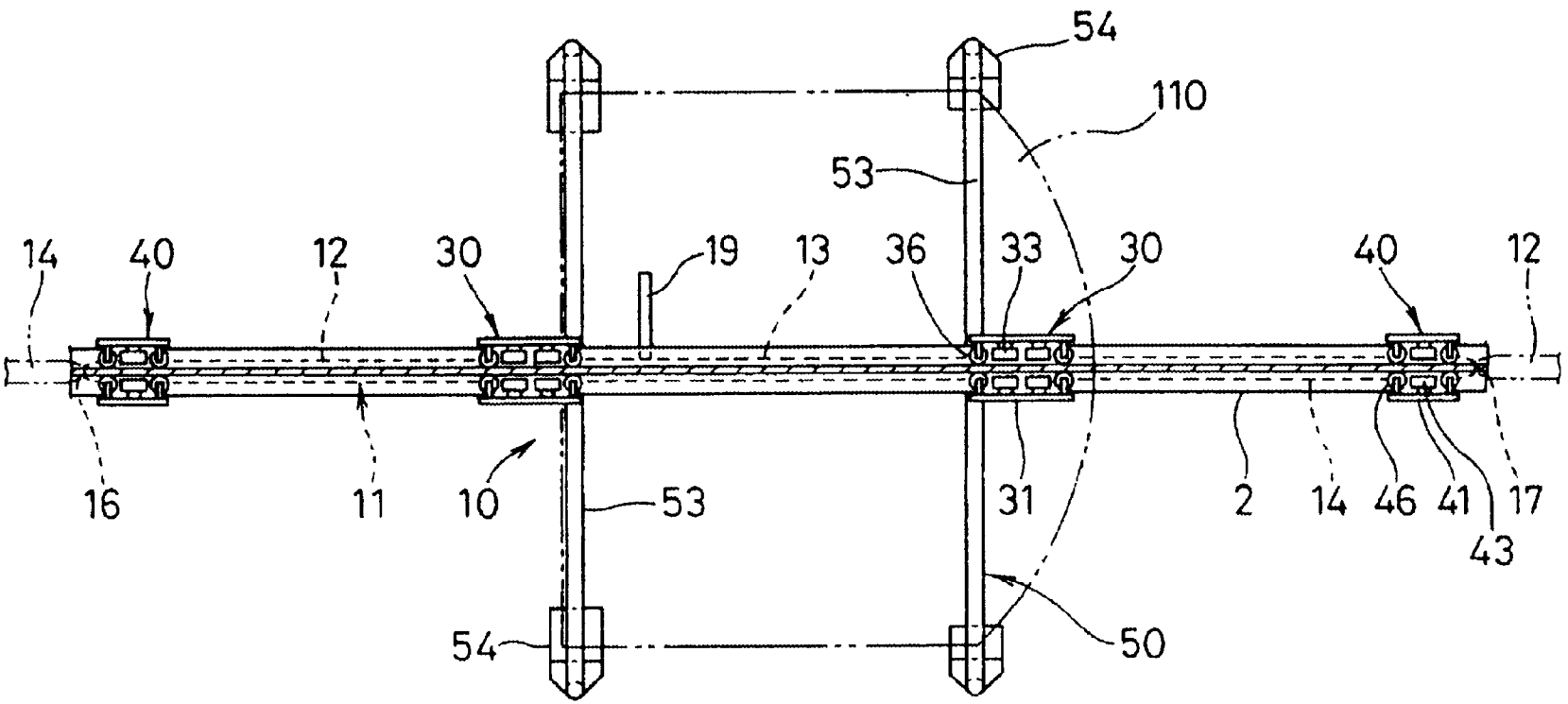
FIG. 9 is a plan view of the movable body in the rectilinear path Portion the transfer system using movable bodies.
Figure 10:
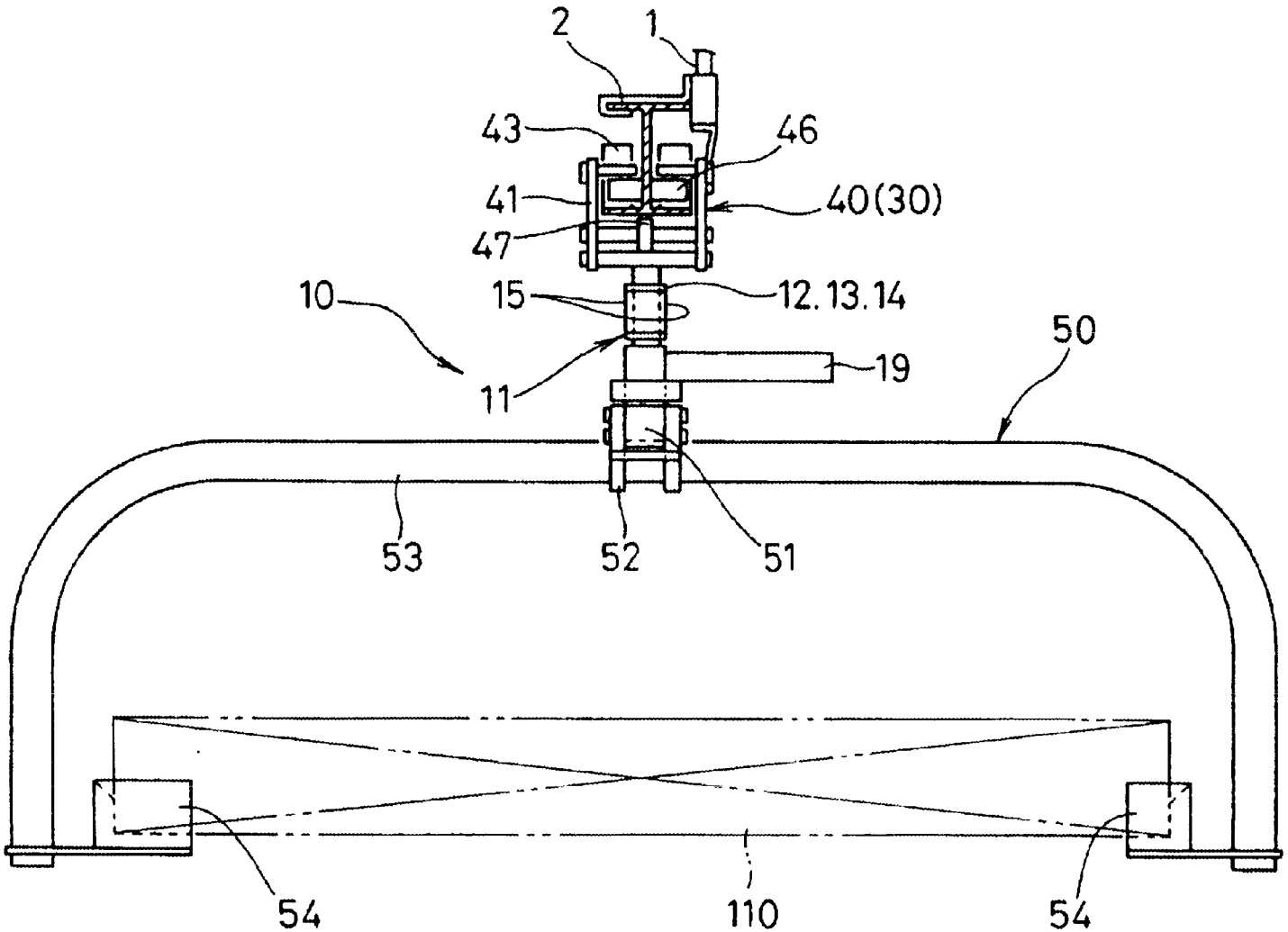
FIG. 10 is a rear view of the movable body in the rectilinear path portion the transfer system using movable bodies.
Figure 13:
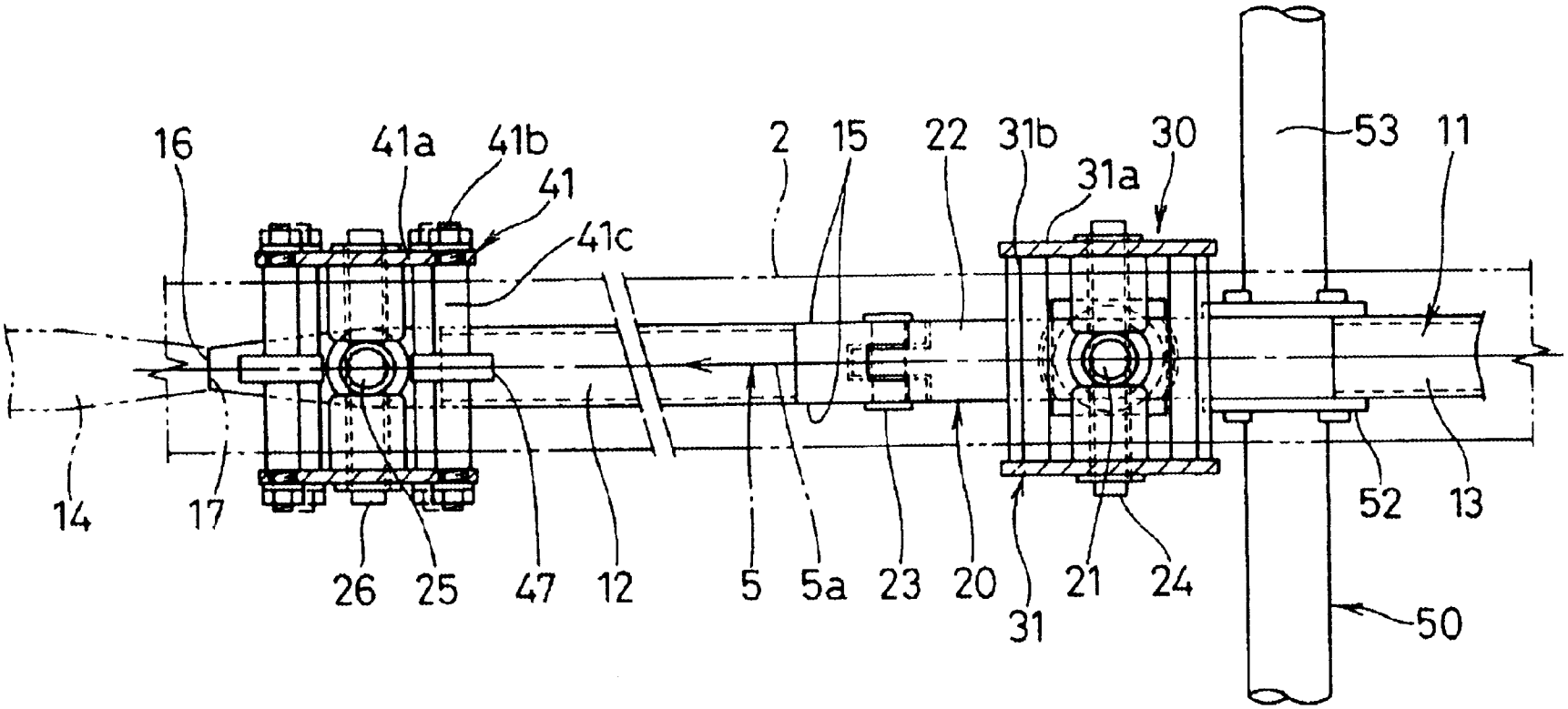
FIG. 13 is a plan view, partly broken away, of the principal portions of the movable body in the transfer system using movable bodies.

In that case, this fed-in movable body 10 is abutted at the abutment 16 of its front end against the abutment 17 of the rear end of the rearmost movable body 10 in the group of movable bodies 10 positioned in the operating path portion 5*a* in the manner of closely connected railroad cars; thus, the group of movable bodies 10 positioned in the manner of closely connected railroad cars in the operating path portion 5*a* are moved at a desired speed by the feed rotating force A of the feed device 60, which means that as shown in a phantom line in FIGS. 9 and 13, the group of movable bodies 10 positioned in a closely connected railroad cars are pushed to be moved.

The movable body 10 thus moved in the operating path portion 5*a* and reaching the terminal end has brakes applied thereto by the brake device 75. That is, in the brake device 75, the brake roller 76 pressed against the driven surface 15 by the same action as in the feed device 60 is forcibly rotated and its feed rotating force B imparts a braking force to the movable body 10.

Since the feed rotating force A from the feed device 60 is greater than the feed rotating force B of the brake roller 76, the difference therebetween causes the movable body 10 corresponding to the brake device 75 to be moved under the braking action. Therefore, in the operating path portion 5*a*, a plurality of movable bodies 10 are moved between the feed device 60 and the brake device 75 as they are arranged in a closely pushed state without producing a clearance between the front and rear ends thereof.

The movement of the movable bodies 10 by the feed device 60 described above is effected by causing the feed roller. 68 to act successively on the driven surface 15 of the front frame body 12, the driven surface 15 of the intermediate frame body 13, and the driven surface 15 of rear frame body 14. Further, the side surface of the connecting body 22 in the connecting devices 20 also serves as a driven surface and is acted on by the feed roller 68.

In that case, when the feed roller 68 is acting on the front frame body 12, the intermediate and rear frame bodies 13 and 14 are moved by being pulled through the connecting devices 20. Further, when the feed roller 68 is acting on the intermediate frame body 13, the front frame body 12 is moved by being pushed from behind through the connecting devices 20, while the rear frame body 14 is moved by being pulled through the connecting devices 20. Further, when the feed roller 68 is acting on the rear frame body 14, the intermediate and front frame bodies 13 and 12 are moved by being pushed from behind through the connecting devices 20.

While the group of movable bodies 10 are being intermittently or continuously moved or intermittently stopped, an operator on the floor, for example, carries out various operations from below with respect to the transfer subject 110 supported by the support section 50.

As shown in FIG. 7, after the movable body 10 moved by being pushed out from the brake device 75 has been moved in the curved path portion 5*b* by the feed device 79, it is fed out to the return path portion 5*c*. The movable body 10 in the return path portion 5*c* is fed out to the divisional rail body 81 by the feed device. 78.

Figure 3:
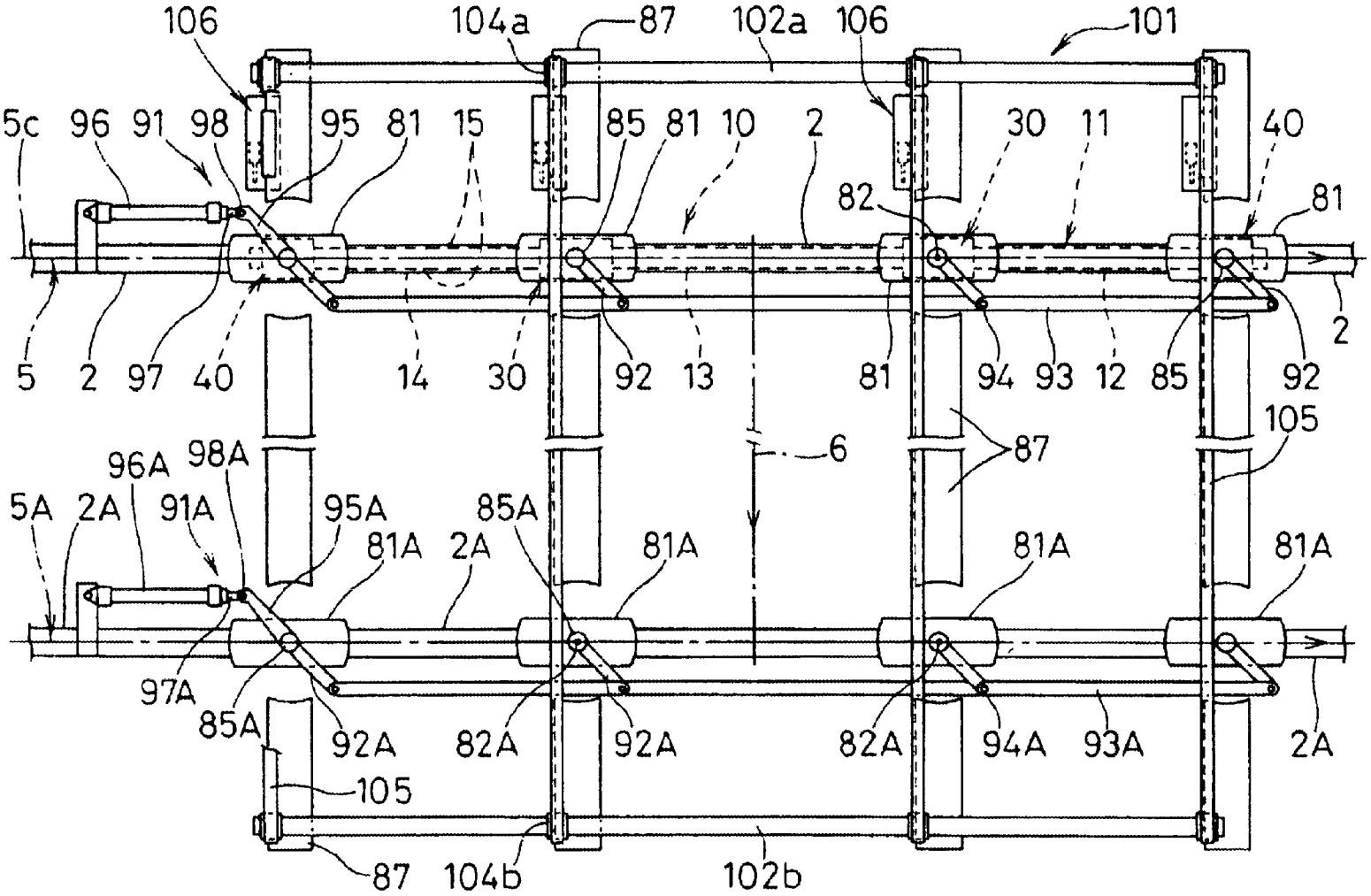
FIG. 3 is a plan view, partly broken away, of the divisional rail body portion, before turning, in the transfer system using movable bodies.

That is, in the divisional rail body 81, as shown in FIGS. 1 and 3, the group of vertical shafts 85 are being synchronously rotated by the extension of the cylinder device 96 of the turning means 91 through the operating link 95, links 92, link plates 93, and the like. This turning movement connects the group of divisional rail bodies 81 to the rail 2 and separates them from the transverse rail body 87.

Therefore, the guided devices 30 and 40 for the movable body 10 moved in by the feed device 78 are transferred from the rail 2 to the group of divisional rail bodies 81. And the movable body 10 is stopped at a predetermined position, that is, at a position where the guided devices 30 and 40 are supported by the corresponding divisional rail bodies 81.

Figure 2:
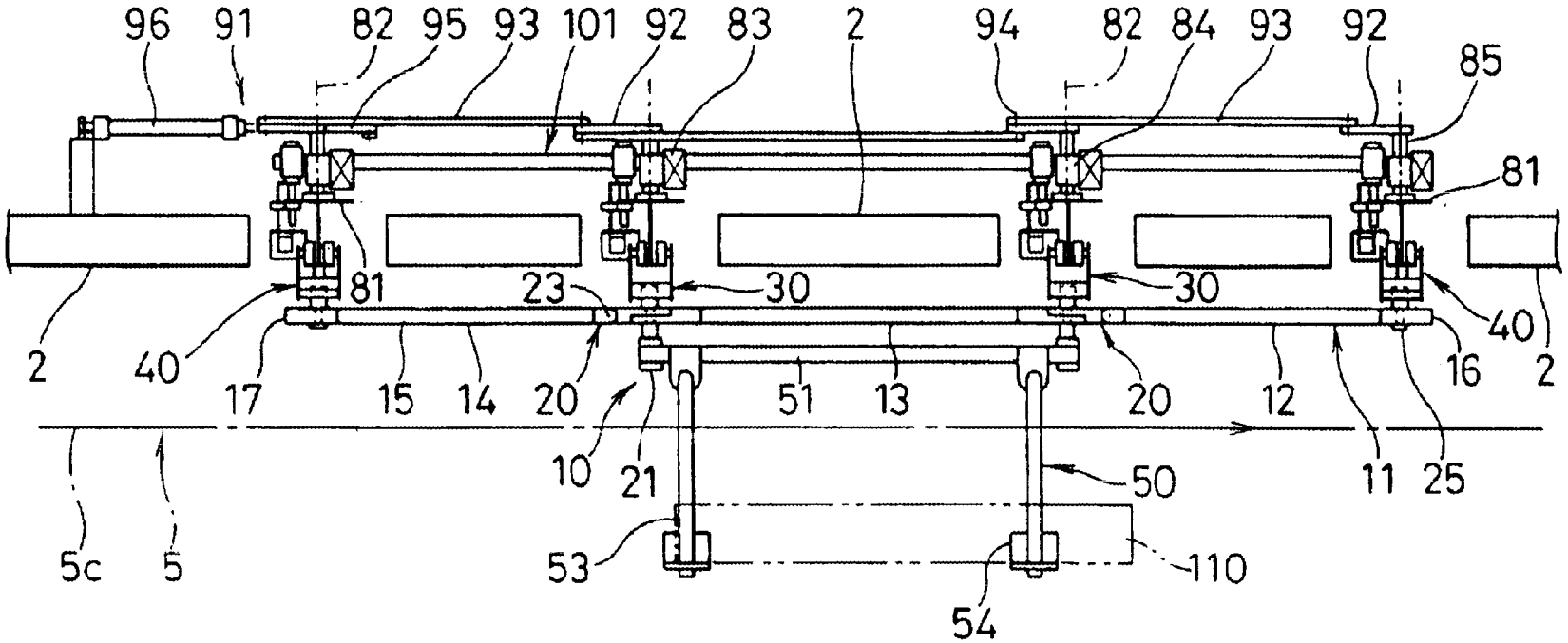
FIG. 2 is side view of the divisional rail body portion, after turning, in the transfer system using movable bodies.
Figure 4:
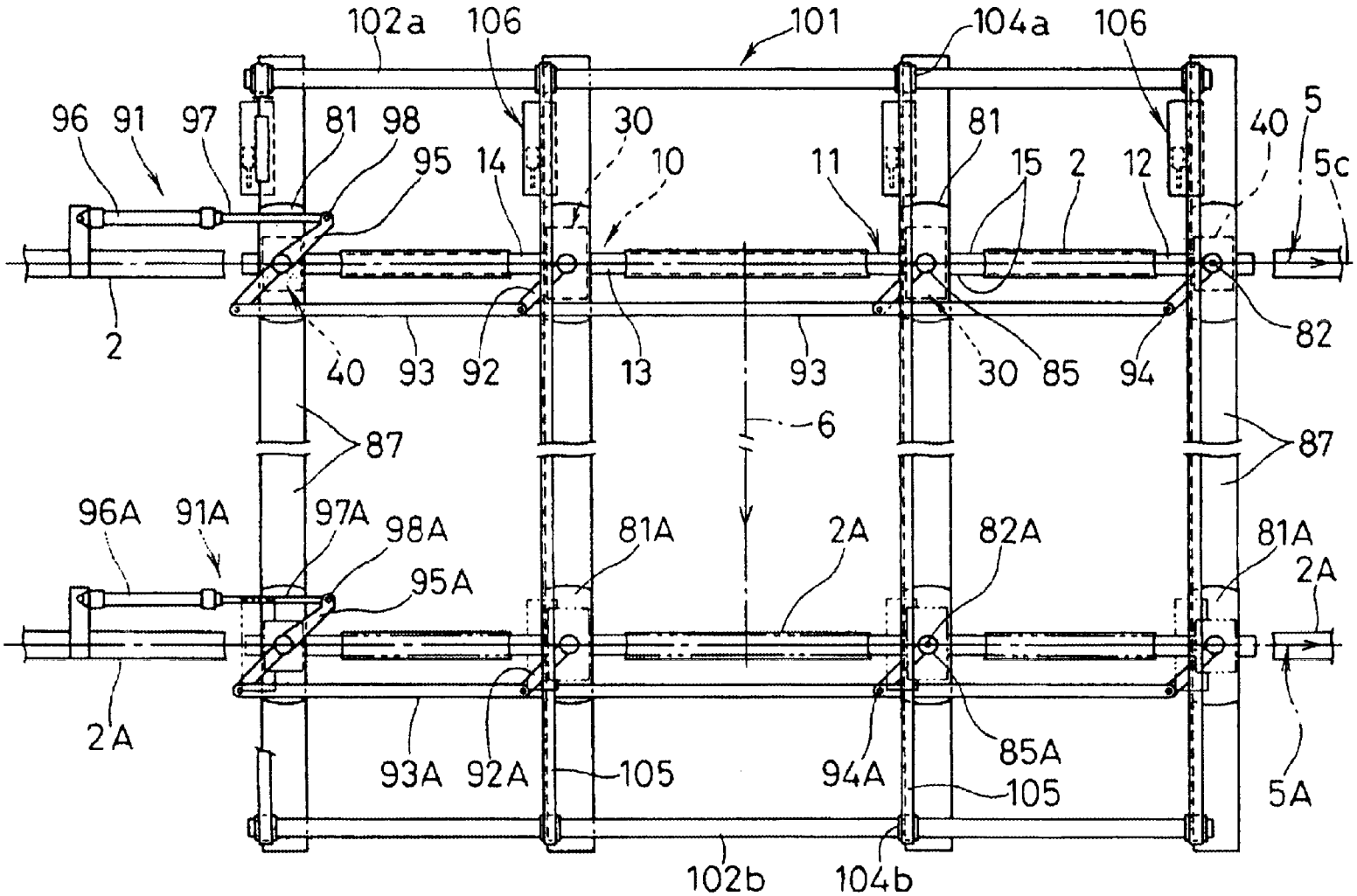
FIG. 4 is a plan view, partly broken away, of the divisional rail body portion, after turning, in the transfer system using movable bodies.
Figure 5:
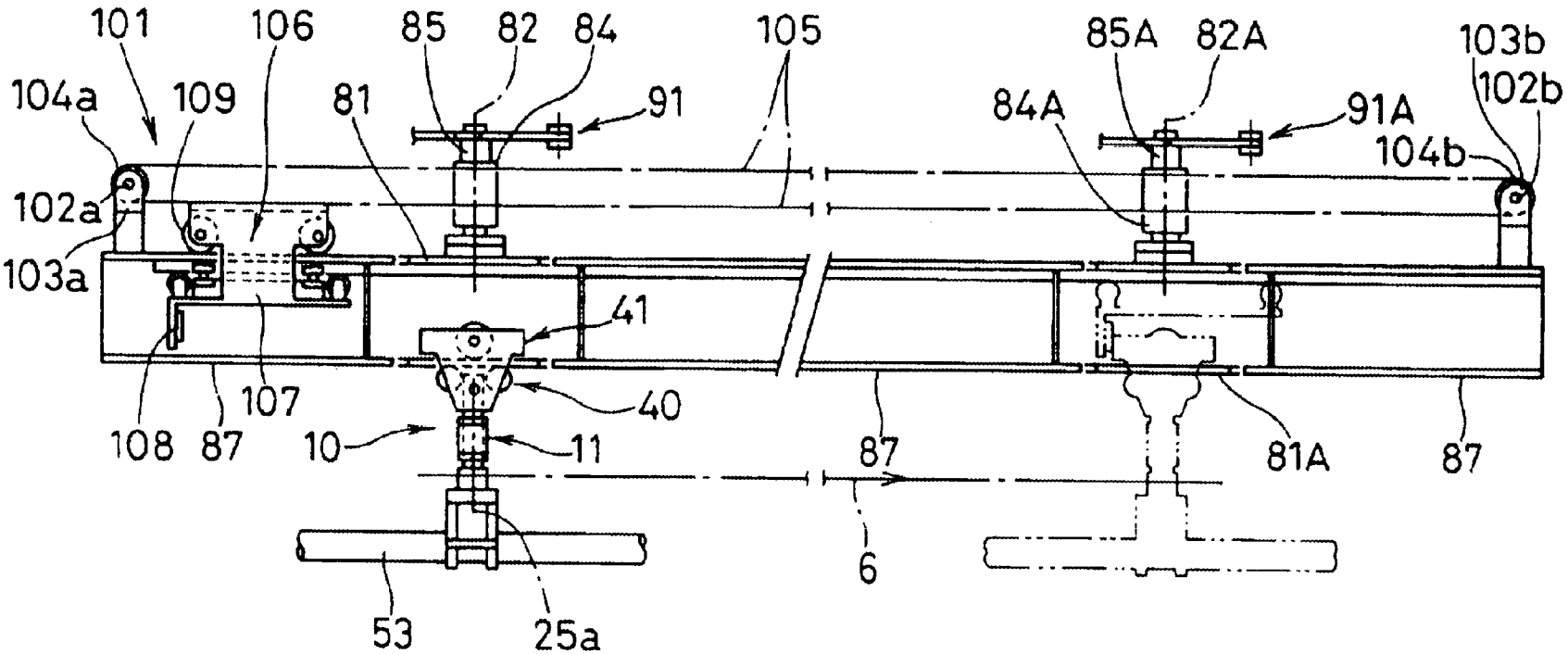
FIG. 5 is a side view of the divisional rail body portion, after turning, in the transfer system using movable bodies.

Then, the contraction of the cylinder device 96 in the turning means 91 causes the group of vertical shafts 85 to be synchronously turned reversely through 90 degrees through the operating link 95, links 92, link plates 93, and the like. This reverse turning causes the group of divisional rail bodies 81, after being separated from the rail 2, to be connected to the transverse rail bodies 87, as shown in FIGS. 2, 4 and 5.

The turning force of such divisional rail body 81 turns the guided devices 30 and 40 around the vertical shafts 21*a* and 25*a* with respect to the main body 11 of the movable body 10 and the support section 50. This results in the guided devices 30 and 40 taking a position facing the transverse path portion 6 although the movable body 10 has its main body 11 taking an attitude lying along the return path portion 5*c*. At this time, the transverse push body 106 of the transverse moving means 101 is standing by on the shorter side of the transverse rail body 87 as shown in a solid line in FIG. 5. Further, the divisional rail body 81A in the other given path 5A is likewise turned and separated from the rail 2A, and then connected to the transverse rail body 87.

Subsequently, the belt 105 is turned by the operation of the transverse moving means 101, whereby the transverse push bodies 106 standing by on the shorter side of the transverse rail body 87 are transferred to the divisional rail body 81 and abutted against the trolley main bodies 31 and 41 of the guided devices 30 and 40, thus moving the group of guided devices 30 and 40 by pushing them from behind through the trolley main bodies 31 and 41.

The group of the guided devices 30 and 40 to be moved by being pushed from behind are transferred from the divisional rail bodies 81 to the longer side of the transverse rail bodies 87 and then moved; thus, the movable body 10 is transversely moved in the transverse path portion 6 with its main body 11 extending along the return path portion 5*c*. And the movable body 10, as shown in a phantom line in FIGS. 4 and 5, is transferred from the transverse rail body 87 to the divisional rail body 81A of the other given path 5A and then stopped.

After the movable body 10 has thus been transversely moved to a predetermined position, the belt 105 is turned reversely by the reverse operation of the transverse moving means 101. Thereby, the transverse push body 106 positioned on the longer side of the transverse rail body 87 is moved backward and transferred to the divisional rail body 81, whereupon it is returned to the shorter side of the transverse rail body 87.

Subsequently, the extension of the cylinders 96 and 96A of both turning means 91 and 91A synchronously rotate the groups of vertical shafts 85 and 85A through the operating links 95 and 95A, links 92 and 92A, link plates 93 and 93A, and the like. This turning causes the groups of divisional rail bodies 81 and 81A to separate from the transverse rail bodies 87 and to connect to the rails 2 and 2A; thus, as shown in FIGS. 1 and 3, the original state is restored.

Such turning force of the divisional rail bodies 81A turns the guided devices 30 and 40 in the direction opposite to what is mentioned above, around the vertical axes 21*a* and 25*a* with respect to the main body 11 of the movable body 10 and the support section 50. This causes the movable body 10 to take an attitude in which its main body 11 and guided devices 30 and 40 extend along the other given path 5A. Therefore, the feed device 78 imparts a moving force to the movable body 10 in the other given path 5A, whereby the movable body 10 is transferred from the divisional rail body 81A to the rail 2A. And it can be moved in the other given path 5A.

Thus, the return path portion 5*c* of the given path 5 is provided with a plurality of divisional rail bodies 81 capable of supporting the groups of guided devices 30 and 40, the turning means 91 being provided for turning these divisional rail bodies 81 around the vertical axes 82, and the return path portion 5*c* is laterally provided with the group of transverse rail bodies 87 connectible to the divisional rail bodies 81 separation-turned with respect to the rail 2, whereby the movable body 10 can be transversely separated from and joined to the given path 5.

Therefore, the path for separating and joining may be short in length. Further, when the transverse path portion 6 consisting of the group of transverse rail bodies 87, for example, is used as a storage path, the movable bodies 10 can be stored with the group of frame bodies 12–14 transversely arranged; therefore, the storage path can be reduced in length according to the storage number. From these facts, the formation of the entire layout of the given path 5 can be easily made and the occupied area for separating, joining or storage can be minimized.

During the movement of the movable bodies 10 described above, the intermediate guided devices 30 are supported and guided through the supported rollers 33 by the rails 2 and 2A, divisional rail bodies 81 and 81A and transverse rail bodies 87, and the guided rollers 35 are guided as they abut against the rails 2 and 2A, divisional rail bodies 81 and 81A and transverse rail bodies 87. Further, the end guided devices 40 are supported and guided by the rails 2 and 2A, divisional rail bodies 81 and 81A and transverse rail bodies 87 through the supported rollers 43, and the guided rollers 46 are guided as they abut against the rails 2 and 2A, divisional rail bodies 81 and 81A and transverse rail bodies 87, with the float preventing rollers 47 opposed from below to the rails 2 and 2A, divisional rail bodies 81 and 81A and transverse rail bodies 87.

Thereby, the movement of the movable bodies 10 is stably effected without rattling, toppling sideways or floating; thus, various operations to the transfer subject 110 and loading and unloading of the transfer subject 110 can be always accurately performed.

Figure 8:
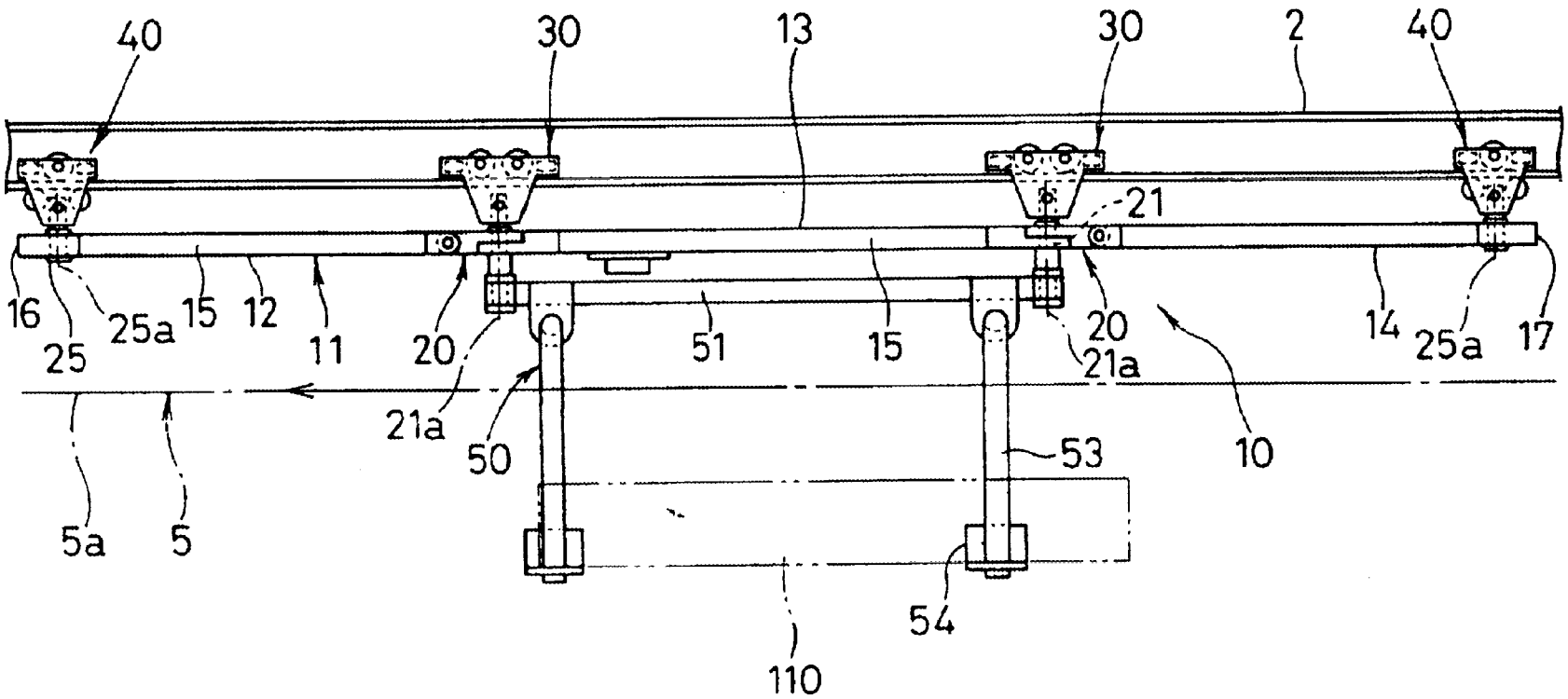
FIG. 8 is a side view of the movable body in a rectilinear path portion in the transfer system using movable bodies.

In the pushing from behind in the given path 5 in the manner of connected railroad cars, and in the linear operating path 5*a*, and the like, as shown in FIGS. 8 and 9, the main bodies 11 of the movable bodies 10, that is, the frame bodies 12, 13 and 14, as seen in a plan view and a side view, take a linear attitude, so that the abutment 16 abuts against the abutment 17 from behind; therefore, the pushing from behind can be smoothly and reliably effected.

Further, it follows that in the left-hand (or right-hand) curved path portion 5*b*, the frame bodies 12, 13 and 14 are moved by being pushed from behind as they are bent, as seen in a plan view, along the curve in the connecting devices 20. Thereby, in a plan view, the relative angle formed between the rear frame body 14 of the preceding movable body 10 and the front frame body 12 of the following movable body 10 is obtuse, with the abutment 16 abutting against the abutment 17 at an obtuse angle, so that the pushing from behind can be smoothly and reliably effected.

In that case, the bending is effected through relative turning around the vertical shaft 21 in the connecting devices 20. Further, the guided devices 30 and 40 are turned around the vertical axes 21*a* and 25*b* through the vertical shafts 21 and 25, whereby they are smoothly moved while automatically changing the direction along the curve transversely of the rails 2 and 2A.

The first embodiment described above may be of a type in which with the movable body 10 taken out to the transverse path portion 6, various operations are applied to the transfer subject 110 supported on this movable body 10. In that case, the support section 50 may be of a type in which it supports the transfer subject 110 always in a given direction with respect to the main body 11 or of a type in which the direction of the transfer subject 110 is changed by 90 degrees.

Figures 18A, 18B:
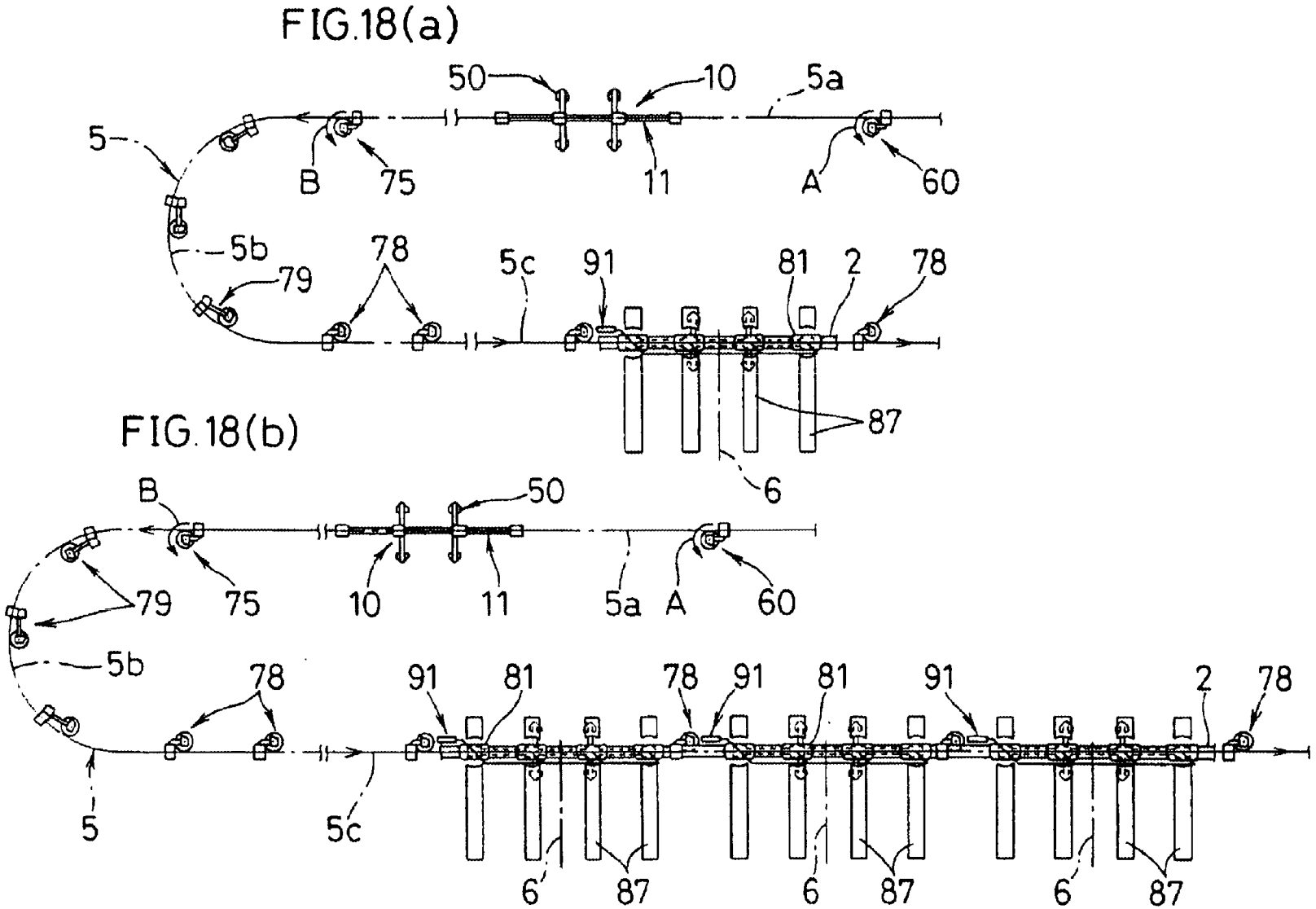
FIG. 18(*a*) is a schematic plan view of a given path portion in a transfer system using movable bodies, according a second embodiment, and FIG. 18(*b*) is a schematic plan view of a given path portion in a transfer system using movable bodies according to a third embodiment.

A second embodiment of the invention will now be described with reference to FIG. 18(*a*). That is, it is of a type in which the movable body 10 taken out of the return path portion 5*c* in the given path 5 to the transverse path portion 6 is returned again to the return path portion 5*c*. At this time, the movable body 10 may be stored in the transverse path portion 6 for a predetermined time or placed in various directions to perform various operations, as described above.

Figure 6:
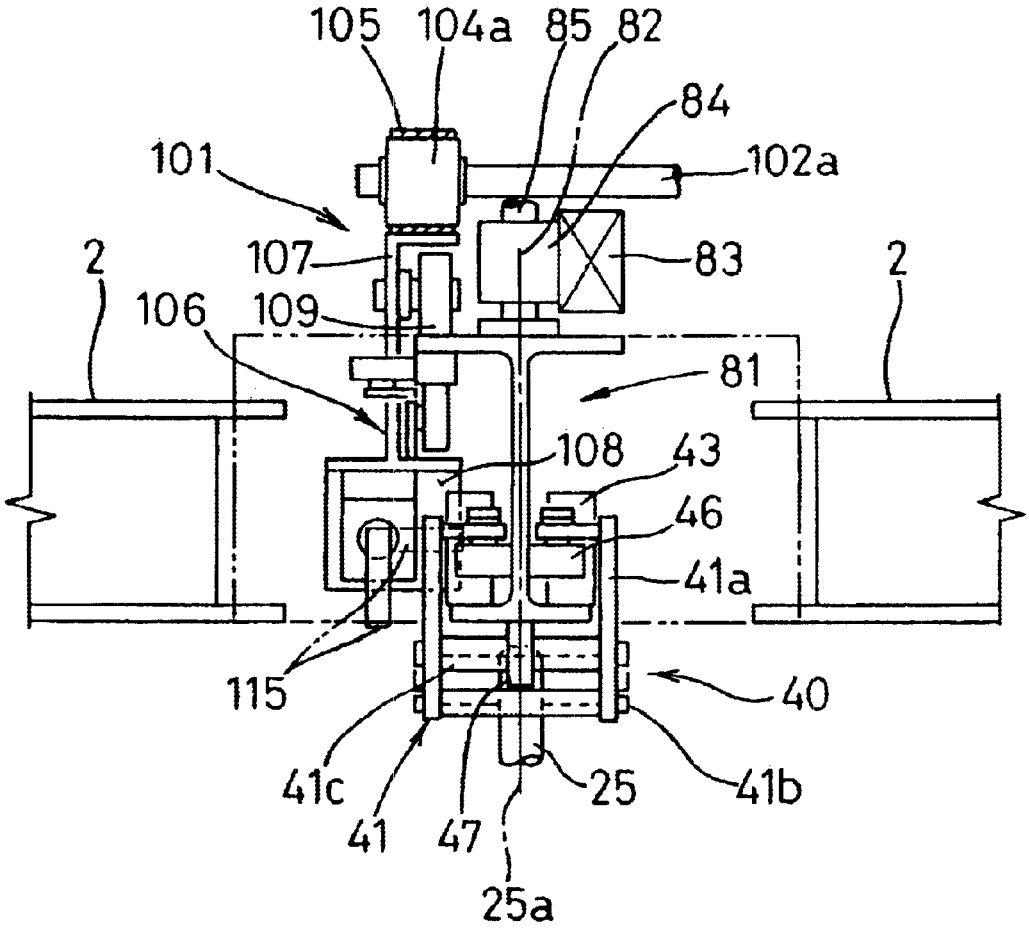
FIG. 6 is a side view, partly broken away, of a transverse movement means portion, after turning, in the transfer system using movable bodies.

In addition, in returning the movable body 10 in the transverse path portion 6 to the return path portion 5*c*, as shown in FIG. 6, for example, a locking element 115 installed on the transverse push body 106 is locked to the trolley bodies 31 and 41 as shown in a phantom line and the transverse push body 106 is moved back, whereby the returning can be smoothly and easily effected by the transverse moving means 101.

A third embodiment of the invention will now be described with reference to FIG. 18(*b*). That is, transverse path portions 6 are formed in a plurality of places laterally of and in the direction of the return path portion 5*c* in the given path 5. According to this third embodiment, a stock path can be formed by using each transverse path portion 6 as a stock portion. In this case, although the movable body 10 is returned to the original given path 5, this may be of a type in which it is delivered to a separate given path, as in the first embodiment described above. In addition, adjusting the order of returning (delivering) enables permutation or change of arrangement.

Figure 19A:
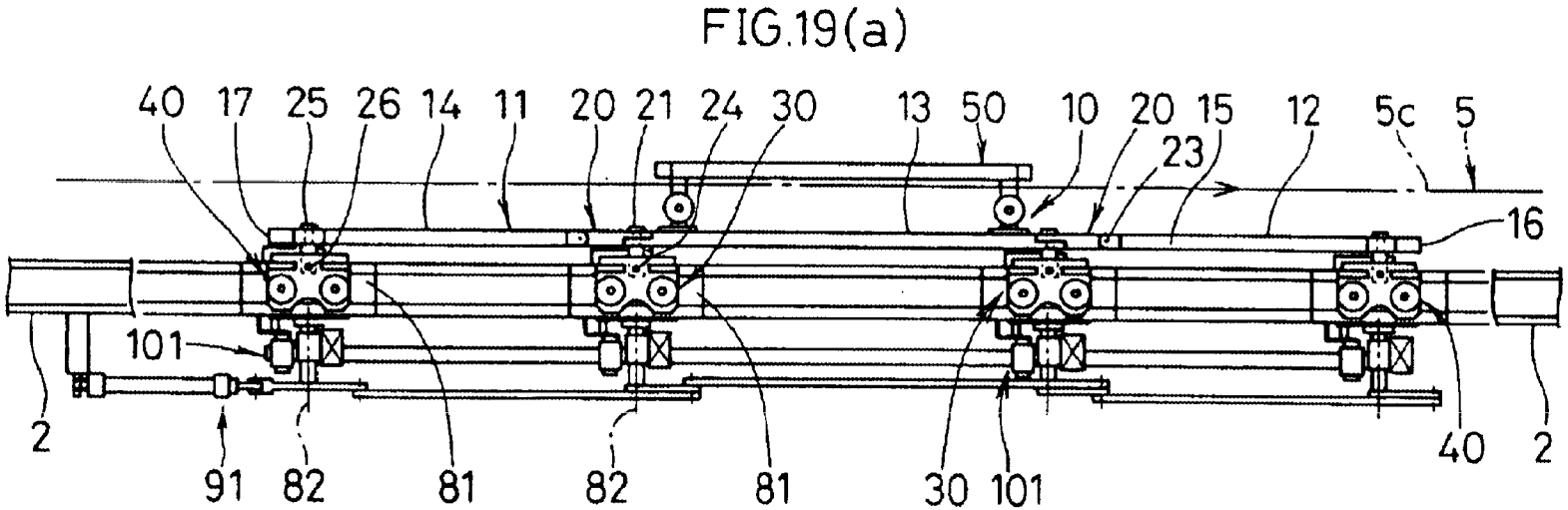
FIG. 19 (*a*) is a side view, partly broken away, of a divisional rail body portion, before turning, in a transfer system using movable bodies, according to a fourth embodiment, and FIG. 19(*b*) is a side view, partly broken away, after turning, according to the fourth embodiment.
Figure 19B:
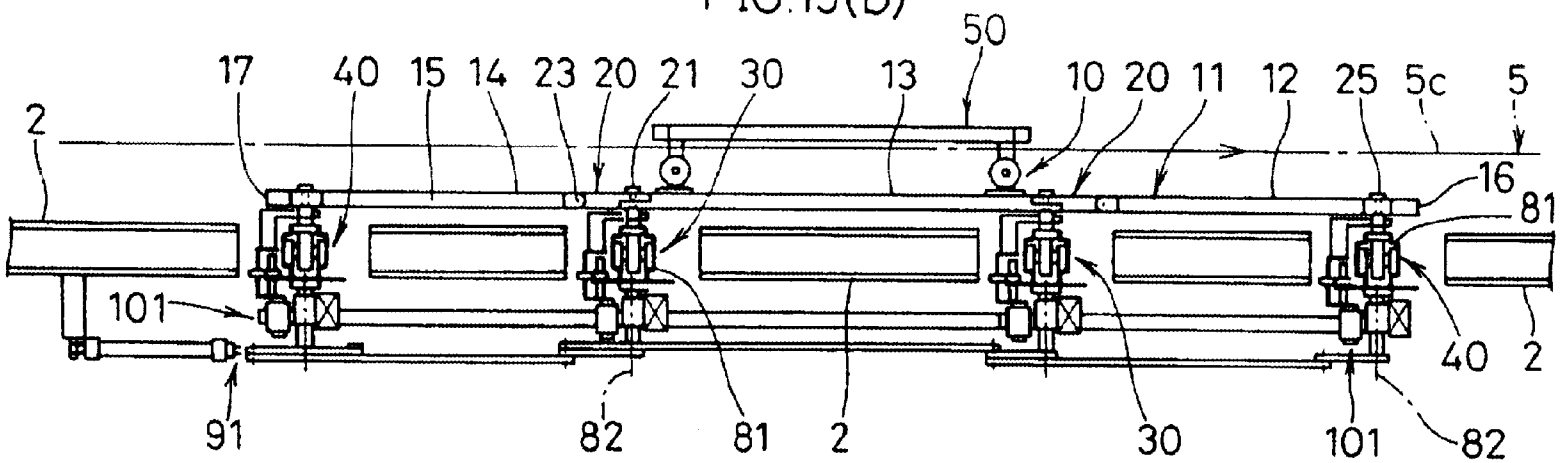
Figure 20:
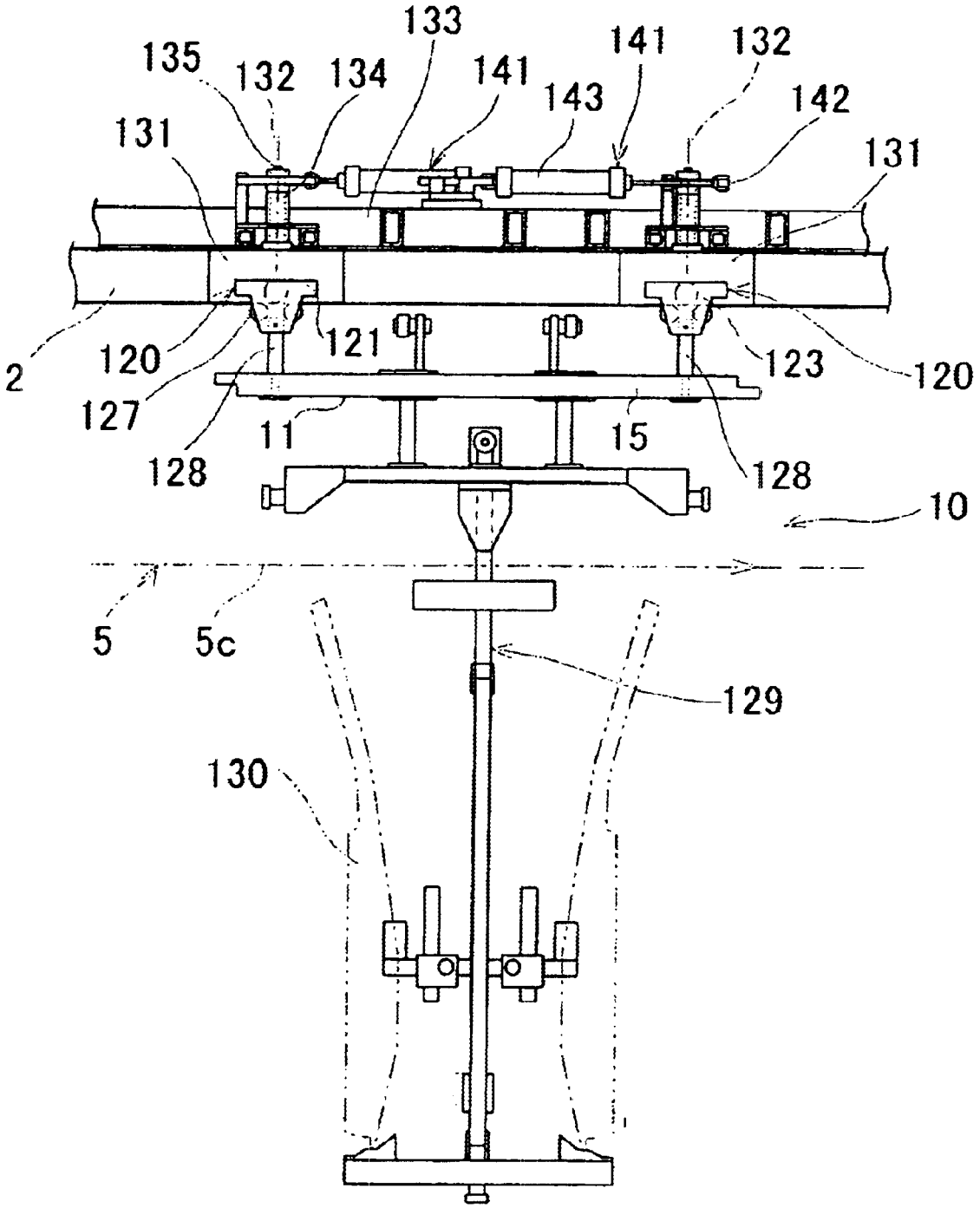
FIG. 20 is a side view of a divisional rail body portion, before being turned, in a transfer system using movable bodies, according to a fifth embodiment of the invention.

A fourth embodiment of the invention, that is, an embodiment employing a movable body 10 that is capable of moving along the floor 1, will now be described with reference to FIG. 19. In addition, in this fourth embodiment, as compared with the first–third embodiments described above, the rails 2 and the divisional rail bodies 81, though differing in particulars such as paired form, are of substantially the same construction. Therefore, the same reference characters are applied to parts identical or similar to those shown in the first–third embodiments described above, omitting a detailed description thereof. In this fourth embodiment, the turning means 91 and transverse moving means 101 are disposed below the rail 2 and divisional rail bodies 81, that is, on the floor (in a pit formed in the floor).

In the first–fourth embodiments described above, the guided devices 30 and 40 are relatively turnably connected to the ends of the vertical shafts 21 relatively turnably connecting the frame bodies 12, 13 and 14. However, they may be of a type in which the guided devices 30 and 40 are horizontally relatively turnably connected through vertical shafts separately installed in the intermediate frame body 13.

In the first–fourth embodiments described above, the main body 11 of the movable body 10 is of a type in which it consists of three frame bodies 12, 13 and 14. However, it may be of another type in which it consists of three or more with one or a plurality of frame bodies connected forwardly or rearwardly of the front frame body 12 or forwardly or rearwardly of the rear frame body 14, or of another type in which it consists of three or more, including a plurality of intermediate frame bodies 13. Further, it may be of another type in which one of the frame bodies 12, 13 and 14 is omitted, using two. In these cases, the number, position, and the like of the divisional rail bodies 81 and 81A are design-changed according to the number, length, and the like of the frame bodies.

In the first–fourth embodiments described above, the type has been, shown in which the connecting device 20 comprises the vertical shaft 21 disposed in the intermediate frame body 13, and the transverse shafts 23 disposed in the front and rear frame bodies 12 and 14. However, other types may be used, including one in which the transverse shaft is disposed in the intermediate frame body 13 and vertical shafts are disposed in the front and rear frame bodies 12 and 14.

In the first–fourth embodiments described above, the drive type shown is such that a plurality of movable bodies 10 are driven for travel in their arranged state from the feed device 60 to the brake device 75 by being closely pushed from, behind without producing any clearance between the front and rear ends of the movable bodies. However, the type may be such that movable bodies 10 are driven for travel with clearances produced between the front end rear ends thereof.

In the first–fourth embodiments described above, the type employed is such that in the return path portion 5*c*, and the like, the movable body 10 is moved with the feed rollers 68 of the feed devices 60, 78, and 79 abutting against the driven surface 15. However, it may be moved by a chain driven type particularly in places where the divisional rail bodies 81 are disposed. That is, other types may be employed, including one in which as shown in FIG. 9, the transmission body on the driving chain side disposed along the return path portion 5*c* may be engaged with and disengaged from the driven pin 10 disposed on the intermediate frame 13. Further, a type may be employed in which the driving belt is abutted against the driven surface 15.

In the first–fourth embodiments described above, the type shown is such that the feed devices 60, 78 and 79, brake device 75, and the like are caused to act on only one of the driven surfaces 15 of the main body 11. However, they may be of another type in which support means, such as support rollers acted on by the other driven surface are installed to clamp the main body 11 from opposite sides to produce a strong friction force, thereby imparting a sufficient travel force or brake force thereto. In that case, the support rollers acted on by the other may be of a force driven type or free rotating type.

Next, a fifth embodiment of the invention will now be described with reference to FIGS. 20–24. That is, the movable body 10 has a single main body 11. And a guided device 120 is relatively turnably installed at each of the front and rear ends of the main body 11.

This guided device 120 is substantially the same as the end guided device 40, and the trolley main body 121 comprises a support plate bodies 121*a*, fixing elements 121*b*, and cylindrical space members 121*c*. And supported rollers 123 are attached to the upper portions of both support plate bodies 121*a* through transverse pins 122.

Further, the upper portions of both support plate bodies 121*a* have connected thereto inwardly directed brackets 124, with guided rollers 126 attached to the brackets 124 through vertical pins 125. A predetermined one of the cylindrical space members 121*c* has a float prevention roller 127 freely rotatably installed thereon. And vertical shafts 128 extending downward from the trolley main body 121 are relatively turnably connected to the front and rear ends of the main body 11. The movable body 10 is provide with a support 129 for the transfer subject 130, positioned below the main body 11.

In the return path portion 5*c*, which is a set path portion in the given path 5, two (plurality) divisional rail bodies 131 capable of supporting the group of guided devices 120 are disposed so that they are rotatable around vertical axes 132. To this end, a pedestal 133 is provided with a bearing 134, in which a vertical shaft 135 is supported for rotation only, with the divisional rail body 131 being connected to the lower end of the vertical shaft 135.

And, turning means 141 for rotating the group of divisional rail bodies 131 around the vertical axes 132 are provided, one for each divisional rail body 131. That is, a link 142 is fixed on the upper end of the vertical shaft 135, and a cylinder device 143 is provided between one end of the link 142 and the pedestal 133. Further, the pedestal 133 is provided is provided with a pair of stop bodies 144 and 145 against which the other end of the link 142 can abut. The 142–145 and the like described above constitute an example of turning means 141.

Disposed laterally of the return path portion 5*c* and over a separate given path 5A are two (plurality) transverse rail bodies 137, which are orthogonal to the return path portion 5*c*, spaced a predetermined distance in the direction of the return path portion 5*c*. And the divisional rail bodies 131 separated and turned with respect to the rail 2 are arranged to be connectible to the transverse rail bodies 137. In addition, the transverse path portion 6 has transverse moving means, and the like disposed therein, and the separate given path 5A has divisional rail bodies, turning means, and the like disposed therein.

According to the fifth embodiment described above, as shown in FIGS. 20 and 22, with the group of divisional rail bodies 131 connected to the rail 2, the guided device 120 for the movable body 10 moved in is transferred from the rail 2 to the group of divisional rail bodies 131. And the movable body 10 is stopped in a predetermined position, that is, the position in which the guided device 120 is supported on the corresponding divisional rail body 131.

Figure 21:
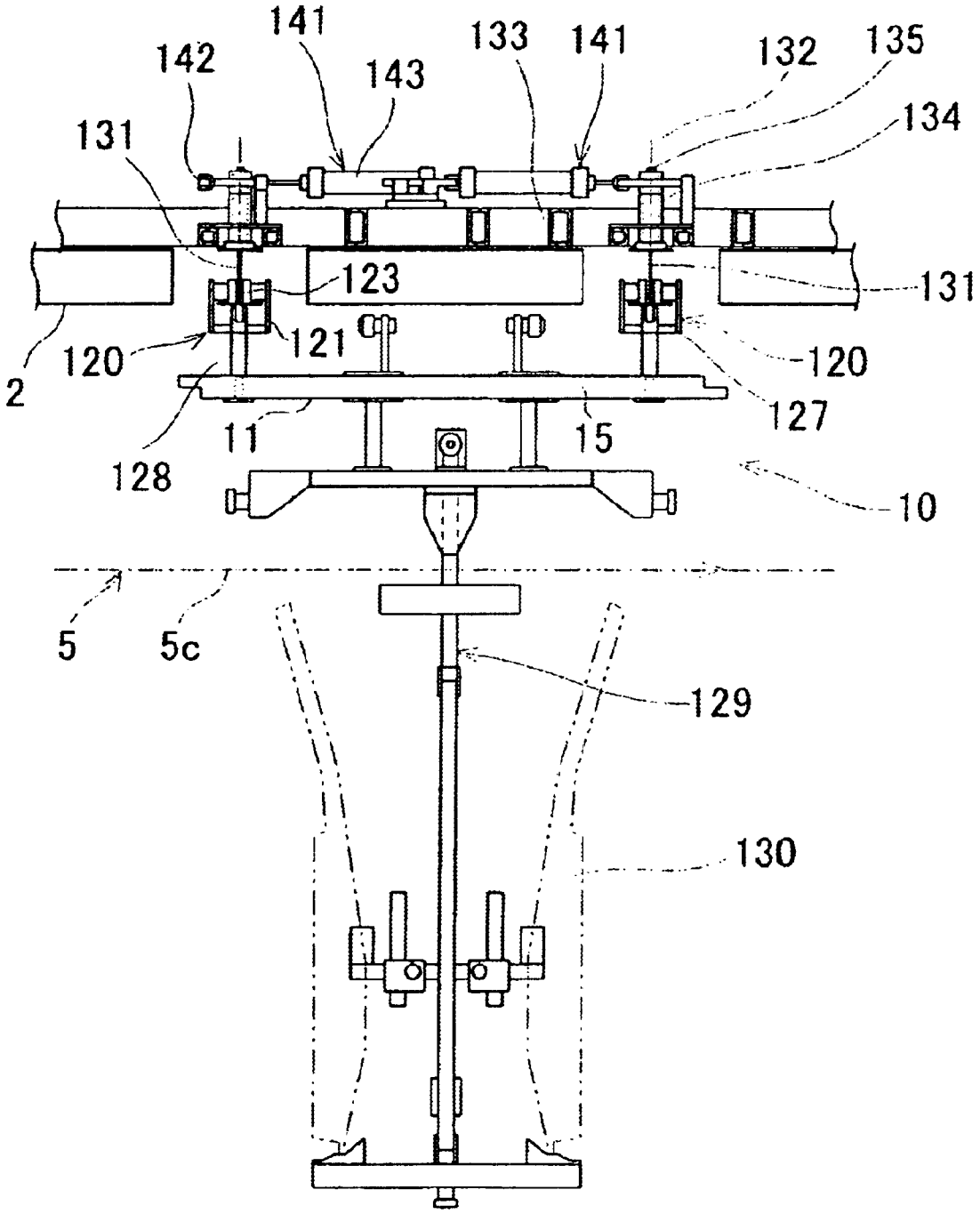
FIG. 21 is a side view of the divisional rail body portion, after turning, the transfer system using movable bodies.
Figure 22:
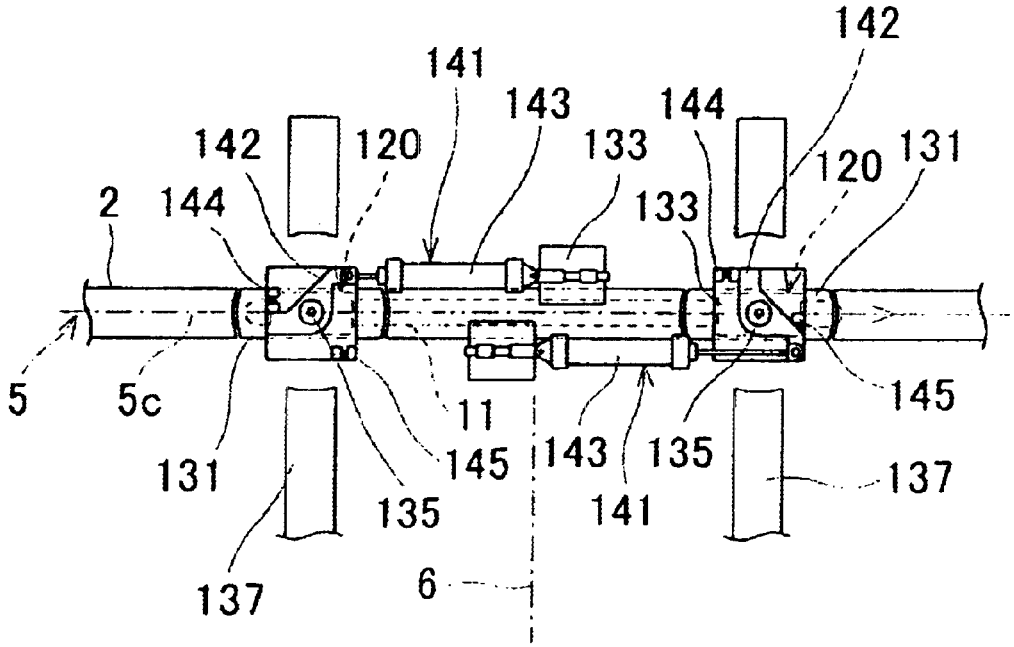
FIG. 22 is a side view, partly broken away, of the divisional rail body portion, before turning, in the transfer system using movable bodies.
Figure 23:
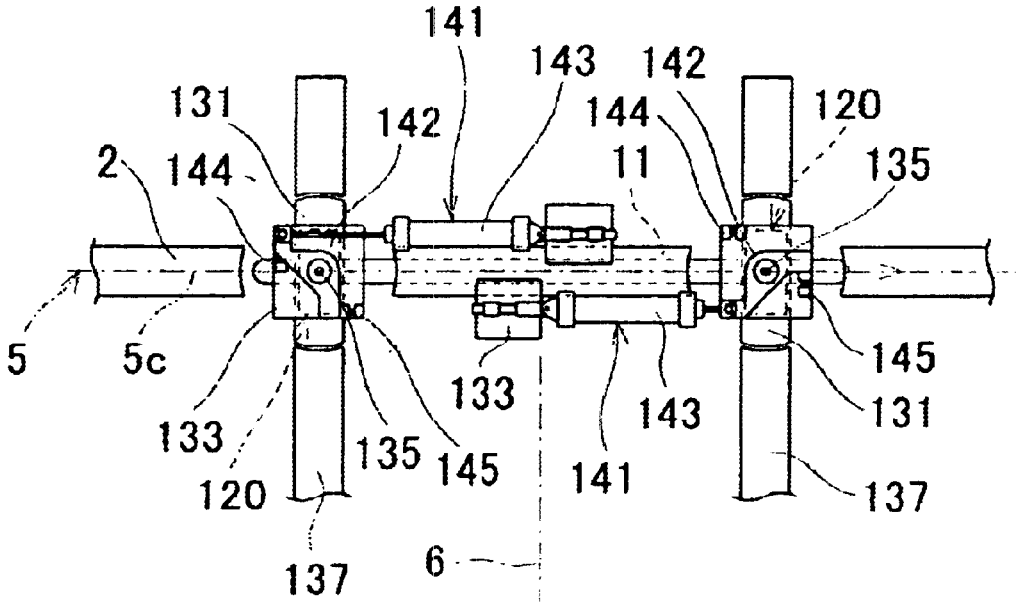
FIG. 23 is a plan view, partly broken away, of the divisional rail body portion, after turning, in the transfer system using movable bodies.
Figure 24:
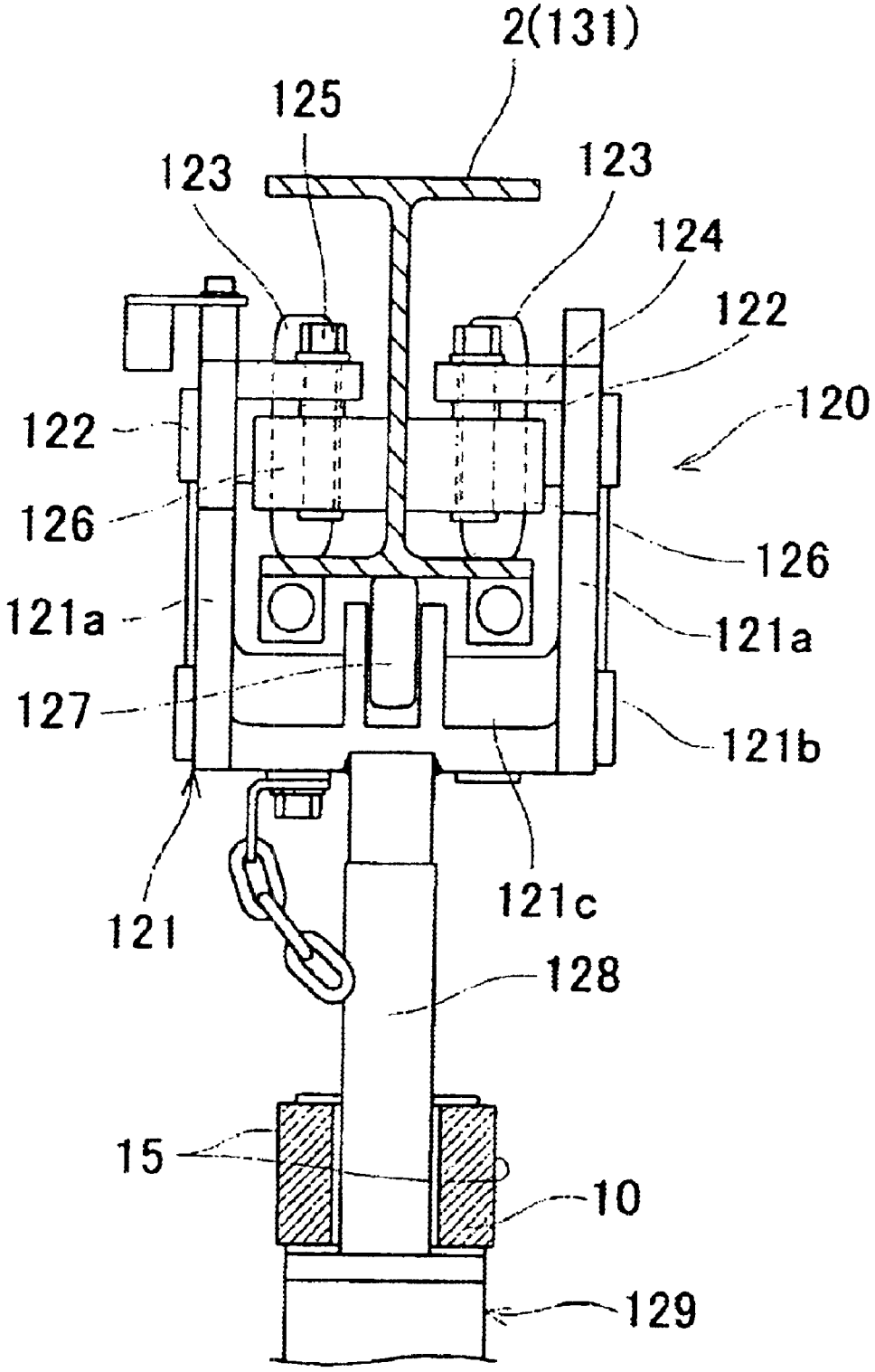
FIG. 24 is a front view of a guided device portion in the transfer system using movable bodies.

Subsequently, the extension and contraction movement of the cylinder device 143 in the turning means 141 causes the vertical shat 135 to turn 90 degrees synchronously through the link 142 and the like. This turning movement separates the group of divisional rail bodies 131 from the rail 2, whereupon, as shown in FIGS. 21 and 23, they are connected to the transverse rail bodies 137.

Such turning force of the divisional rail body 131 turns the guided device 120 around the axis of the vertical shaft 128 with respect to the main body 11 of the movable body 10 and the support 129. This causes the guided device 120 to take an attitude facing the transverse path portion 6 with the movable body 10 having its main body 11 taking an attitude lying along the return path portion 5*c*.

Subsequently, the operation of the transverse moving means causes the group of guided devices 120 to be moved by being pushed from behind through the trolley main body 121. The group of guided devices 120 being moved by being pushed from behind are transferred from the divisional rail bodies 131 to the transverse rail bodies 137 and then moved; thus, the movable body 10 is transversely moved in the transverse path portion 6 with its main body 11 taking an attitude lying along the return path portion 5*c*.

In the first–fifth embodiments described above, the return path portion 5*c* for moving the movable bodies 10 supporting the transfer subjects 110 and 130 are shown as the set path portion; however, they can be easily employed for another path portion, such as for moving an empty movable body 10.

What is claimed is:

1. A transfer system using movable bodies that are supported and guided on a rail through a plurality of guided devices connected to main bodies of the movable bodies so that the movable bodies are movable in a given path, the main bodies being provided with supports for a transfer subject, wherein the plurality of guided devices are relatively turnably connected to the main bodies through vertical shafts, the given path has a set path portion which includes therein a plurality of divisional rail bodies capable of supporting the plurality of guided devices, and turning means for turning the divisional rail bodies around vertical axes, and there are provided laterally of said set path portion a group of transverse rail bodies to which the divisional rail bodies can be connected when turned for separation with respect to the rail.

2. A transfer system using movable bodies, in which the movable bodies are supported and guided by a rail through a plurality of guided devices so that they are movable in a given path, the movable body having a main body composed of a plurality of frame bodies horizontally connected to be relatively turnable through connecting devices, at least one of said frame bodies being provided with a support section for transfer subjects, wherein the plurality of guided devices are relatively turnably connected to the movable bodies through vertical shafts, the given path has a set path portion which includes therein a plurality of divisional rail bodies capable of supporting the plurality of guided devices, and turning means for turning the divisional rail bodies around vertical axes, and there are provided laterally of said set path portion a group of transverse rail bodies to which the divisional rail bodies can be connected when turned for separation with respect to the rail.

3. The transfer system using movable bodies as set forth in claim 2, wherein each connecting device horizontally connects the frame bodies to be relatively turnable through a vertical shaft, and each of the guided devices is relatively turnably connected to the end of the vertical shaft.

4. The transfer system using movable bodies as set forth in claim 2, wherein each connecting device horizontally connects the frame bodies to be relatively turnable through a vertical shaft and vertically connects the frame bodies to be relatively turnable through a transverse shaft, and an end of the vertical shaft and each of the guided devices is relatively turnably connected through a transverse pin passing through the end of the vertical shaft.

5. The transfer system using movable bodies as set forth in claim 1 or 2, wherein the main body of the movable body has a side surface formed as a driven surface, and a feed device having a feed roller capable of abutting against the driven surface is disposed in the given path.

6. The transfer system using movable bodies as set forth in claim 2, wherein the movable body is provided with a support section for transfer subjects, said support section being disposed in a lower portion of at least one of the frame bodies.

* * * * *